US009037067B2

(12) United States Patent
Ikuno et al.

(10) Patent No.: US 9,037,067 B2
(45) Date of Patent: May 19, 2015

(54) IMAGE FORMING APPARATUS AND PROCESS CARTRIDGE

(71) Applicants: Hiroshi Ikuno, Kanagawa (JP); Yohta Sakon, Kanagawa (JP); Masahiro Ohmori, Kanagawa (JP); Kazuhiro Egawa, Shizuoka (JP); Tetsuya Toshine, Shizuoka (JP)

(72) Inventors: Hiroshi Ikuno, Kanagawa (JP); Yohta Sakon, Kanagawa (JP); Masahiro Ohmori, Kanagawa (JP); Kazuhiro Egawa, Shizuoka (JP); Tetsuya Toshine, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 65 days.

(21) Appl. No.: 13/752,754

(22) Filed: Jan. 29, 2013

(65) Prior Publication Data

US 2013/0243506 A1 Sep. 19, 2013

(30) Foreign Application Priority Data

Mar. 13, 2012 (JP) ..... 2012-055986

(51) Int. Cl.
*G03G 21/00* (2006.01)
*G03G 21/18* (2006.01)

(52) U.S. Cl.
CPC ..... *G03G 21/0017* (2013.01); *G03G 21/1814* (2013.01)

(58) Field of Classification Search
USPC ..... 399/350
See application file for complete search history.

(56) References Cited

U.S. PATENT DOCUMENTS

| | | | | |
|---|---|---|---|---|
| 5,923,925 | A * | 7/1999 | Nakamura et al. | 399/159 |
| 2005/0266325 | A1* | 12/2005 | Yanagawa et al. | 430/58.7 |
| 2011/0135361 | A1* | 6/2011 | Kabata et al. | 399/350 |
| 2011/0217102 | A1* | 9/2011 | Ohmori et al. | 399/350 |

FOREIGN PATENT DOCUMENTS

| | | |
|---|---|---|
| JP | 1-205171 | 8/1989 |
| JP | 7-333881 | 12/1995 |
| JP | 8-15887 | 1/1996 |
| JP | 8-123053 | 5/1996 |
| JP | 8-146641 | 6/1996 |
| JP | 9-127846 | 5/1997 |
| JP | 2002-341571 | 11/2002 |
| JP | 2004-233818 | 8/2004 |
| JP | 2004-233881 | 8/2004 |
| JP | 2010-191378 | 9/2010 |
| JP | 2011-145457 | 7/2011 |
| JP | 2012-83729 | 4/2012 |

* cited by examiner

*Primary Examiner* — Ryan Walsh
(74) *Attorney, Agent, or Firm* — Cooper & Dunham LLP

(57) ABSTRACT

An image forming apparatus including at least a photoreceptor; and a cleaning blade formed of a strip-shaped elastic blade to contact an edge line to the surface of the photoreceptor, wherein the photoreceptor includes a surface layer comprising a particulate material, and the edge line of the cleaning blade includes a substrate of the elastic blade; a mixed layer having a thickness not less than 1.0 μm, formed of the substrate and at least one of an acrylic resin and a methacrylic resin, located at the surface of the substrate; and a surface layer having a thickness not less than 0.1 μm, formed of at least one of an acrylic resin and a methacrylic resin, located on the surface of the substrate.

5 Claims, 7 Drawing Sheets

PROJECTED IMAGE OF PARTICLE PERIPHERAL LENGTH: C1

AREA: S

CIRCLE WITH AREA OF S PERIPHERAL LENGTH: C2

AREA: S

IMAGE FORMING APPARATUS AND PROCESS CARTRIDGE

CROSS-REFERENCE TO RELATED APPLICATIONS

This patent application is based on and claims priority pursuant to 35 U.S.C. §119 to Japanese Patent Application No. 2012-055986, filed on Mar. 13, 2012, in the Japan Patent Office, the entire disclosure of which is hereby incorporated by reference herein.

BACKGROUND OF THE INVENTION

1. Field of the Invention

The present invention relates to an image forming apparatus such as copiers, printers, facsimiles and direct digital platemakers, and a process cartridge used therein.

2. Description of the Related Art

In electrophotographic image forming apparatuses, residual toner remaining on the surface of a photoreceptor even after a toner image thereon is transferred onto a recording material or an intermediate transfer medium is removed therefrom using a cleaner.

Strip-shaped cleaning blades made of an elastic material such as polyurethane rubbers are typically used for such a cleaner because of having advantages such that the cleaner has simplified structure and good cleanability. Among such cleaning blades, a cleaning blade in which one end thereof is supported by a supporter, and an edge line of the other end is contacted with a surface of a photoreceptor to block and scrape off residual toner on the photoreceptor, thereby removing the residual toner from the surface of the photoreceptor.

In attempting to meet a recent need of forming high quality images, there are image forming apparatuses using spherical toner (hereinafter referred to as polymerization toner), which has a relatively small particle diameter and which is prepared by a method such as polymerization methods. Since such polymerization toner has such an advantage as to have higher transfer efficiency than pulverization toner, which has been conventionally used, the polymerization toner can meet the need. However, polymerization toner has such a drawback as not to be easily removed from a photoreceptor by a cleaning blade. This is because such polymerization toner has a spherical form and a small particle diameter, and easily passes through a small gap between the tip of a cleaning blade and the surface of a photoreceptor.

In attempting to prevent polymerization toner from passing through a gap between a cleaning blade and a photoreceptor, it is necessary to increase the pressure to the cleaning blade contacted with the surface of the photoreceptor to enhance the cleanability of the cleaning blade.

However, as disclosed in Japanese published unexamined application No. JP-2010-191378-A, when the contact pressure of the cleaning blade is increased, the friction between the cleaning blade and the photoreceptor is increased, and thereby the tip of the cleaning blade is pulled by the photoreceptor in the moving direction of the photoreceptor. Specifically, as illustrated in FIG. 8(*a*), a cleaning blade 62 is pulled by the surface of an photoreceptor 123 in a moving direction (indicated by an arrow) of the photoreceptor due to increase of friction between the blade and the photoreceptor, thereby causing a problem (hereinafter referred to as everted-tip problem) in that an edge line 62*c* of a tip 62*a* of the blade 62 is everted. In this regard, the thus everted tip has a restoring force, and therefore the tip tends to vibrate, resulting in generation of fluttering sounds. In addition, when the cleaning operation is continued while the edge line 62*c* of the cleaning blade 62 is everted, a portion of the tip 62*a* of the cleaning blade 62, which is apart from the edge line 62*c* by few micrometers, is abraded as illustrated in FIG. 8(*b*). When the cleaning blade 62 is further used for the cleaning operation, the portion of the tip 62*a* of the blade 62 is further abraded, resulting in lack of the edge line 62*c* of the blade 62 as illustrated in FIG. 8(*c*). The cleaning blade 62 having no edge line cannot remove residual toner from the surface of the photoreceptor 123, thereby forming an abnormal image in which background thereof is soiled with residual toner.

Japanese published unexamined application No. JP-2010-191378-A discloses a cleaning blade formed of a low-friction elastic blade, the surface of which is impregnated with at least one of an isocyanate compound, a fluorine compound and a silicone compound; and a surface layer covering an edge line of the elastic blade, formed of a UV curing resin harder than the elastic blade.

The cleaning blade having an edge line a surface layer harder than the elastic blade is formed on can prevent the edge line from deforming in a travel direction of a photoreceptor. Further, even when the surface layer is worn out and an edge line of the elastic blade is exposed, the impregnated part thereof contacts the photoreceptor and a frictional force between the elastic blade and the photoreceptor is reduced to prevent the exposed part from deforming. This prevents the edge line from being everted and increases abrasion resistance of the cleaning blade to prevent poor cleaning.

Japanese Patent No. JP-3602898-B1 (Japanese published unexamined application No. JP-H09-127846-A) discloses a cover layer made of a resin, which is harder than a rubber and has a pencil hardness of from B to 6H, is formed at least on the edge line of the tip of a cleaning blade. Japanese published unexamined application No. JP-2004-233818-A discloses a cleaning blade formed of an elastic blade impregnated with an ultraviolet crosslinkable material including a silicone so as to be swelled and surface layer harder than the elastic blade on at least a part of the cleaning blade contacting a photoreceptor, which is formed when the elastic blade is exposed to ultraviolet rays.

However, even when the above-mentioned cleaning blades are used, occurrence of the above-mentioned problems is hardly prevented if images having a high image area proportion (such as image having large solid images) are continuously produced (i.e., if the amount of residual toner on a photoreceptor to be removed by the cleaning blade is large). The reason is considered to be as follows.

Specifically, since the blade has a cover layer on the tip thereof or includes a crosslinked material in a surface portion thereof in the longitudinal direction thereof, the elastic property of the rubber of the blade tends to deteriorate. When the elastic property of the blade is deteriorated, the blade cannot be satisfactorily contacted with the surface of a photoreceptor (i.e., the pressure of the blade to a photoreceptor varies) if the photoreceptor is eccentric or the surface thereof is waved. In addition, when images having high image area proportions are continuously produced and a large amount of residual toner is present on the surface of the photoreceptor, the large amount of toner is collected at the tip of the blade by being blocked by the blade. In this case, the residual toner at the tip of the blade tends to pass through a relatively large gap formed between a portion of the blade and the surface of the photoreceptor, which are contacted with each other at a relatively low pressure due to eccentricity of the photoreceptor or waving of the surface thereof, resulting in occurrence of the above-mentioned abnormal image problem.

In the cleaning blade including an elastic blade formed a urethane rubber impregnated with an isocyanate compound and a surface layer harder than the elastic blade, disclosed in Japanese published unexamined application No. JP-2010-191378-A, the isocyanate compound chemically reacts with the urethane rubber, resulting in high crosslink density of the impregnated part of the elastic blade. Such an elastic blade deteriorates in elasticity and followability to eccentric variation of a photoreceptor, resulting in poor cleanability.

In the cleaning blade including an elastic blade and a surface layer formed of a resin having a pencil hardness of from B to 6H, disclosed in Japanese Patent No. JP-3602898-B1 (Japanese published unexamined application No. JP-H09-127846-A), the surface layer does not have enough abrasion resistance and is likely to early disappear due to friction with a photoreceptor. Then, when the surface layer thickness is made thicker, the elastic blade deteriorates in elasticity and followability to eccentric variation of a photoreceptor, resulting in poor cleanability.

In the cleaning blade formed of an elastic blade impregnated with an ultraviolet crosslinkable material including a silicone so as to be swelled and surface layer harder than the elastic blade on at least a part of the cleaning blade contacting a photoreceptor, which is formed when the elastic blade is exposed to ultraviolet rays, disclosed in Japanese published unexamined application No. JP-2004-233818-A, a large amount of the ultraviolet crosslinkable material needs to be impregnated to form a surface layer having sufficient hardness. However, when a large amount of the ultraviolet crosslinkable material is impregnated, the impregnated part is formed too hard and deep, resulting in deterioration of elasticity of the elastic blade. Therefore, the edge line of the cleaning blade deteriorates in followability to the surface of a photoreceptor, resulting in poor cleanability.

In addition, when a cleaning blade having an edge line harder than the elastic blade is used, the surface of a photoreceptor is abraded earlier than when only the elastic blade is used, resulting in deterioration of image quality such as background fouling.

Japanese published unexamined application No. JP-2010-191378-A discloses an image forming apparatus using a photoreceptor the cleaning blade having an edge line harder than the elastic blade contacts, including a surface layer formed of a crosslinkable charge transport material. However, the image forming apparatus just includes a combination of a cleaning blade and a photoreceptor each having improved mechanical durability. Hard layers contact each other with friction, abrasion of the cleaning blade or the photoreceptor is accelerated as time passes, resulting in poor cleanability.

Further, when the image forming apparatus using having a hard edge line continues to produce images on which a toner is eccentrically consumed in an axial direction of a photoreceptor, the surface of the photoreceptor is abraded in proportion to the toner consumption eccentricity, i.e., the photoreceptor is eccentrically abraded. Even a photoreceptor including a surface layer formed of a crosslinkable charge transport material is eccentrically abraded.

Because of these reasons, a need exist for an image forming apparatus using a cleaning blade including an elastic blade and an edge line harder than the elastic blade, in which the edge line has good followability to a photoreceptor to maintain good cleanability, and preventing the photoreceptor from being eccentrically abraded.

SUMMARY OF THE INVENTION

Accordingly, one object of the present invention to provide an image forming apparatus using a cleaning blade including an elastic blade and an edge line harder than the elastic blade, in which the edge line has good followability to a photoreceptor to maintain good cleanability, and preventing the photoreceptor from being eccentrically abraded.

Another object of the present invention to provide a process cartridge used in the image forming apparatus.

These objects and other objects of the present invention, either individually or collectively, have been satisfied by the discovery of an image forming apparatus, comprising:

a photoreceptor;

a charger configured to charge the surface of the photoreceptor;

an irradiator configured to irradiate the surface thereof to form an electrostatic latent image thereon;

an image developer configured to develop the electrostatic latent image with a toner to form a toner image;

a transferer configured to transfer the toner image onto a recording medium;

a fixer configured to fix the toner image on the recording medium; and a cleaning blade formed of a strip-shaped elastic blade and configured to contact an edge line to the surface of the photoreceptor, wherein the photoreceptor comprises a surface layer comprising a particulate material, and the edge line of the cleaning blade comprises:

a substrate of the elastic blade;

a mixed layer having a thickness not less than 1.0 μm, formed of the substrate and at least one of an acrylic resin and a methacrylic resin, located at the surface of the substrate; and a surface layer having a thickness not less than 0.1 μm, formed of at least one of an acrylic resin and a methacrylic resin, located on the surface of the substrate.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 9A is an example in which a photosensitive layer including an inorganic particulate material is formed on a substrate, FIG. 9B is an example in which a single-layered photosensitive layer and a surface layer are formed on a substrate, FIG. 9C is an example in which a multilayered photosensitive layer and a surface layer are formed on a substrate, and FIG. 9D is an example in which an undercoat layer, a multilayered photosensitive layer and a surface layer are formed on a substrate.

DETAILED DESCRIPTION OF THE INVENTION

Figure 1A:
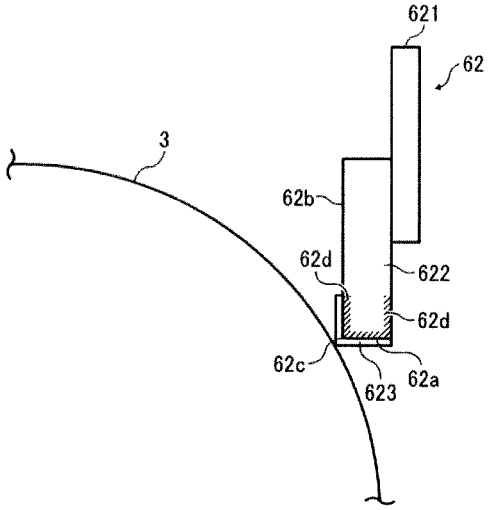
FIGS. 1A and 1B are schematic cross-sectional views illustrating an example of the cleaning blade of this disclosure.

The present invention provides an image forming apparatus using a cleaning blade including an elastic blade and an edge line harder than the elastic blade, in which the edge line has good followability to a photoreceptor to maintain good cleanability, and preventing the photoreceptor from being eccentrically abraded.

More particularly, the present invention relates to an image forming apparatus, comprising:

a photoreceptor;

a charger configured to charge the surface of the photoreceptor;

an irradiator configured to irradiate the surface thereof to form an electrostatic latent image thereon;

an image developer configured to develop the electrostatic latent image with a toner to form a toner image;

a transferer configured to transfer the toner image onto a recording medium;

a fixer configured to fix the toner image on the recording medium; and a cleaning blade formed of a strip-shaped elastic blade and configured to contact an edge line to the surface of the photoreceptor, wherein the photoreceptor comprises a surface layer comprising a particulate material, and the edge line of the cleaning blade comprises:

a substrate of the elastic blade;

a mixed layer having a thickness not less than 1.0 μm, formed of the substrate and at least one of an acrylic resin and a methacrylic resin, located at the surface of the substrate; and a surface layer having a thickness not less than 0.1 μm, formed of at least one of an acrylic resin and a methacrylic resin, located on the surface of the substrate.

In the present invention, as mentioned later in Examples, a combination of a photoreceptor having the surface layer and a cleaning blade having the edge line improves followability of the edge line of the cleaning blade to the photoreceptor to maintain good cleanability while preventing the photoreceptor and the cleaning blade from being excessively abraded and making abnormal noises, and the edge line of the cleaning blade from being everted. In addition, the eccentric abrasion of the photoreceptor can be prevented as well.

It is thought this is because of the following reasons.

The photoreceptor of the present invention including the particulate material in its surface layer increases in mechanical strength and improves in durability. Therefore, abrasions if the surface of the photoreceptor and the edge line of the cleaning blade are prevented. Even when images on which a toner is eccentrically consumed in an axial direction of a photoreceptor are continuously produced, the eccentric abrasion of the photoreceptor is improved.

Further, the acrylic and/or the methacrylic resin used in the surface layer of the cleaning blade of the present invention have better durability than resins having conventionally been used. In addition, since both of the surface layer and the mixed layer include the acrylic and/or the methacrylic resin, the acrylic and/or the methacrylic resin of the mixed layer exert a so-called anchor effect to those of the surface layer, and it is thought an adhesion between the surface layer and the elastic blade is increased. This is thought to further improve the durability of the surface layer. Furthermore, since the acrylic and/or the methacrylic resin used to form the mixed layer perform crosslink reaction without chemically bonding with the elastic blade differently from a conventionally-used isocyanate compound, it is not thought the elastic blade deteriorate in elasticity due to too high crosslink density of the mixed layer.

The cleaning blade having such a surface layer and a mixed layer each including the acrylic and/or the methacrylic resin and having the above-mentioned thickness is thought to prevent the edge line from deforming in a travel direction of the photoreceptor to avoid making abnormal noises and eversion of the edge line, and to have followability to the photoreceptor. Thus, the excessive abrasion and the eccentric abrasion of the photoreceptor are thought prevented because the cleaning blade contacts the photoreceptor having a surface layer including the particulate material.

Figure 2:
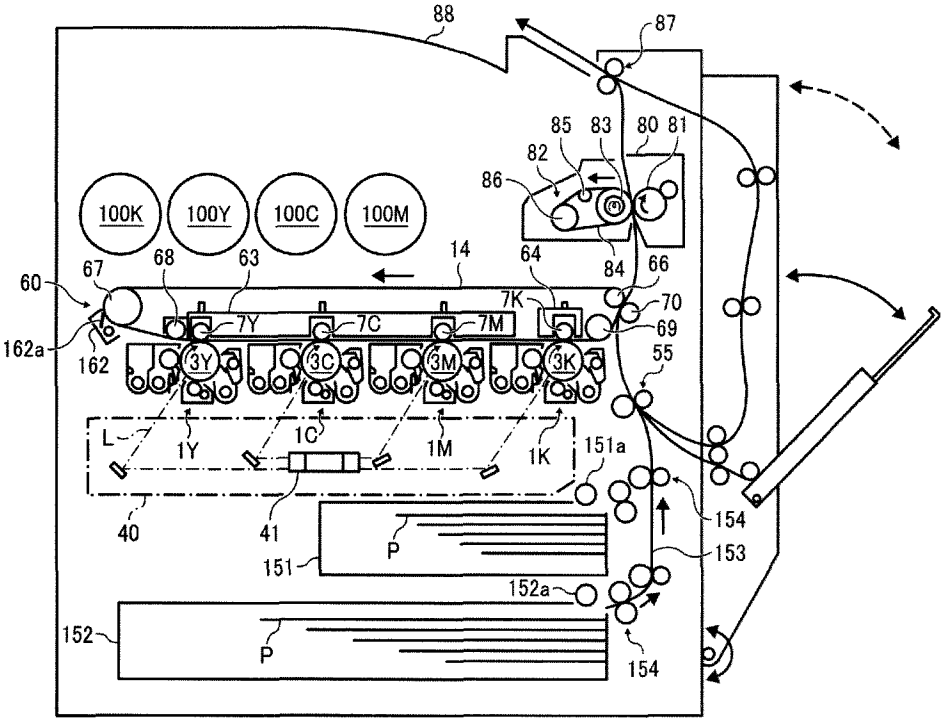
FIG. 2 is a schematic cross-sectional view illustrating an example of the image forming apparatus of this disclosure.

Initially, an example of the image forming apparatus of this disclosure will be described by reference to drawings. FIG. 2 illustrates an electrophotographic printer as an example of the image forming apparatus of this disclosure.

Referring to FIG. 2, a printer 500 includes four image forming units, i.e., yellow (Y), cyan (C), magenta (M) and black (K) image forming units 1Y, 1C, 1M and 1K. The four image forming units 1Y, 1C, 1M and 1K have the same configuration except that the color of toner used for developing an electrostatic latent image on a photoreceptor is different.

The printer 500 further includes a transfer unit 60, which includes an intermediate transfer belt 14 and which is located above the four image forming units 1. As mentioned later in detail, Y, C, M and K toner images formed on respective photoreceptors 3Y, 3C, 3M and 3K serving as photoreceptors are transferred onto the surface of the intermediate transfer belt 14 so as to be overlaid, resulting in formation of a combined color toner image on the intermediate transfer belt 14.

In addition, an optical writing unit 40 serving as a latent image former is located below the four image forming units 1. The optical writing unit 40 emits light beams L (such as laser beams) based on Y, C, M and K image information to irradiate the photoreceptors 3Y, 3C, 3M and 3K with the laser beams L, thereby forming electrostatic latent images, which respectively correspond to the Y, C, M and K images to be formed, on the photoreceptors. The optical writing unit 40 includes a polygon mirror 41, which is rotated by a motor and which reflects the light beams L emitted by a light source of the optical writing unit while deflecting the laser beams to irradiate the photoreceptors 3Y, 3C, 3M and 3K with the laser beams L via optical lenses and mirrors. The optical writing unit 40 is not limited thereto, and an optical writing unit using a LED array or the like can also be used therefor.

Below the optical writing unit 40, a first sheet cassette 151, and a second sheet cassette 152 are arranged so that the first sheet cassette is located above the second sheet cassette. Each of the sheet cassettes 151 and 152 contains a stack of paper sheets P serving as a recording material. Uppermost sheets of the paper sheets P in the first and second sheet cassettes 151 and 152 are contacted with a first feed roller 151*a* and a second feed roller 152*a*, respectively. When the first feed roller 151*a* is rotated (counterclockwise in FIG. 2) by a driver (not shown), the uppermost sheet P in the first sheet cassette 151 is fed by the first feed roller 151*a* toward a sheet passage 153 located on the right side of the printer 500 while extending vertically. Similarly, when the second feed roller 152*a* is rotated (counterclockwise in FIG. 2) by a driver (not shown), the uppermost sheet P in the second sheet cassette 152 is fed by the second feed roller 152*a* toward the sheet passage 153.

Plural pairs of feed rollers 154 are arranged in the sheet passage 153. The paper sheet P fed into the sheet passage 153 is fed from the lower side of the sheet passage 153 to the upper side thereof while being pinched by the pairs of feed rollers 154.

A pair of registration rollers 55 is arranged on the downstream side of the sheet passage 153 relative to the sheet feeding direction. When the pair of registration rollers 55 pinches the tip of the paper sheet P thus fed by the pairs of feed rollers 154, the pair of registration rollers 55 is stopped once, and is then rotated again to timely feed the paper sheet P to a secondary transfer nip mentioned below so that a combined color toner image on the intermediate transfer belt 14 is transferred onto the predetermined position of the paper sheet P.

Figure 3:
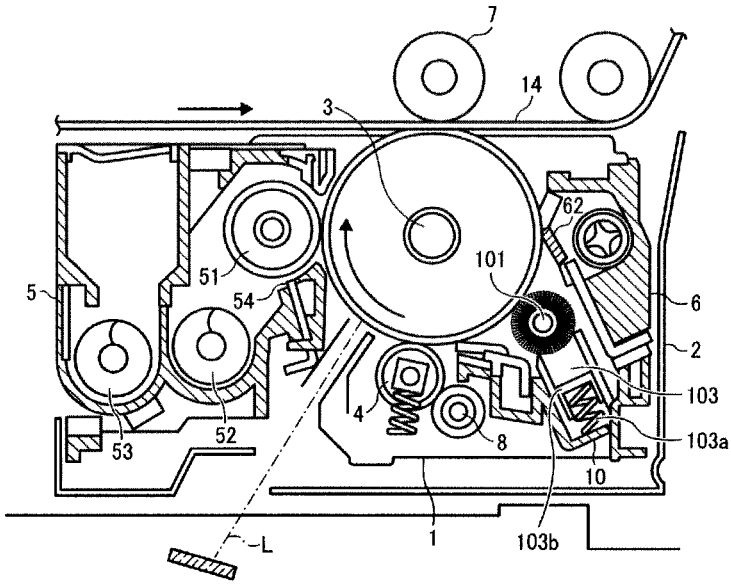
FIG. 3 is a schematic cross-sectional view illustrating an image forming unit of the image forming apparatus illustrated in FIG. 2.

FIG. 3 illustrates one of the four image forming units 1.

As illustrated in FIG. 3, the image forming unit 1 includes a drum-shaped photoreceptor 3 serving as a photoreceptor. The shape of the photoreceptor 3 is not limited thereto, and sheet-shaped photoreceptors, endless belt-shaped photoreceptors and the like can also be used.

Around the photoreceptor 3, a charging roller 4, an image developer 5, a primary transfer roller 7, a cleaner 6, a lubricant applicator 10, a discharging lamp (not shown), etc., are arranged. The charging roller 4 serves as a charger for charging a surface of the photoreceptor 3. The image developer 5 serves as an image developer for developing an electrostatic latent image formed on the photoreceptor 3 with a developer to form a toner image thereon. The primary transfer roller 7 serves as a primary transferer for transferring the toner image on the photoreceptor 3 to the intermediate transfer belt 14. The cleaner 6 serves as a cleaner for removing residual toner from the surface of the photoreceptor 3 after transferring the toner image. The lubricant applicator 10 serves as a lubricant applicator for applying a lubricant to the surface of the photoreceptor 3 after cleaning the surface. The discharging lamp (not shown) serves as a discharger for decaying residual charges remaining on the surface of the photoreceptor 3 after cleaning the surface.

The charging roller 4 is arranged in the vicinity of the photoreceptor 3 with a predetermined gap therebetween, and evenly charges the photoreceptor 3 so that the photoreceptor 3 has a predetermined potential with a predetermined polarity. The thus evenly charged surface of the photoreceptor 3 is irradiated with the light beam L emitted by the optical writing unit 40 based on image information, thereby forming an electrostatic latent image on the surface of the photoreceptor 3.

The image developer 5 has a developing roller 51 serving as a developer bearing member. A development bias is applied to the developing roller 51 by a power source (not shown). A supplying screw 52 and an agitating screw 53 are provided in a casing of the image developer 5 to feed the developer in opposite directions in the casing so that the developer is charged so as to have a charge with a predetermined polarity. In addition, a doctor 54 is provided in the image developer to form a developer layer having a predetermined thickness on the surface of the developing roller 51. The layer of the developer, which has been charged so as to have a charge with the predetermined polarity, is adhered to an electrostatic latent image on the photoreceptor 3 at a development region, in which the developing roller 51 is opposed to the photoreceptor 3, resulting in formation of a toner image on the surface of the photoreceptor 3.

The cleaner 6 includes a fur brush 101, the cleaning blade 62, etc. The cleaning blade 62 is contacted with the surface of the photoreceptor 3 in such a manner as to counter the rotated photoreceptor 3. The cleaning blade 62 will be described later in detail.

The lubricant applicator 10 includes a solid lubricant 103, and a pressing spring 103*a* to press the solid lubricant 103 toward the fur brush 101 serving as a lubricant applicator to apply the lubricant to the surface of the photoreceptor 3. The solid lubricant 103 is supported by a bracket 103*b* while being pressed toward the fur brush 101 by the pressing spring 103*a*. The solid lubricant 103 is scraped by the fur brush 101, which is driven by the photoreceptor 3 so as to rotate (counterclockwise in FIG. 3), thereby applying the lubricant 103 to the surface of the photoreceptor 3. By thus applying the lubricant, the friction coefficient of the surface of the photoreceptor 3 can be controlled so as to be not higher than 0.2.

Although the non-contact short-range charging roller 4 is used as the charger of the image forming unit 1, the charger is not limited thereto, and contact chargers (such as contact charging rollers), corotrons, scorotrons, solid state chargers, and the like can also be used for the charger. Among these chargers, contact chargers, and non-contact short-range chargers are preferable because of having advantages such that the charging efficiency is high, the amount of ozone generated in a charging operation is small, and the charger can be miniaturized.

Specific examples of light sources for use the optical writing unit 40 and the discharging lamp include any known light emitters such as fluorescent lamps, tungsten lamps, halogen lamps, mercury lamps, sodium lamps, light emitting diodes (LEDs), laser diodes (LDs), electroluminescent lamps (ELs), and the like.

In order to irradiate the photoreceptor 3 with light having a wavelength in a desired range, sharp cut filters, bandpass filters, infrared cut filers, dichroic filters, interference filters, color temperature converting filters, and the like can be used.

Among these light sources, LEDs and LDs are preferably used because of having advantages such that the irradiation energy is high, and light having a relatively long wavelength of from 600 to 800 nm can be emitted.

The transfer unit 60 serving as a transferer includes not only the intermediate transfer belt 14, but also a belt cleaning unit 162, a first bracket 63, and a second bracket 64. In addition, the transfer units 60 further includes four primary transfer rollers 7Y, 7C, 7M and 7K, a secondary transfer backup roller 66, a driving roller 67, a supplementary roller 68, and a tension roller 69. The intermediate transfer belt 14 is rotated counterclockwise in an endless manner by the driving roller 67 while being tightly stretched by the four rollers. The four primary transfer rollers 7Y, 7C, 7M and 7K press the thus rotated intermediate transfer belt 14 toward the photoreceptors 3Y, 3C, 3M and 3K, respectively, to form four primary transfer nips. In addition, a transfer bias having a polarity opposite that of the charge of the toner is applied to the backside (i.e., inner surface) of the intermediate transfer belt (for example, a positive bias is applied when a negative toner is used). Since the intermediate transfer belt 14 is rotated endlessly, yellow, cyan, magenta and black toner images, which are formed on the photoreceptors 3Y, 3C, 3M and 3K, respectively, are sequentially transferred onto the intermediate transfer belt 14 so as to be overlaid, resulting in formation of a combined color toner image on the intermediate transfer belt 14.

The secondary transfer backup roller 66 and a secondary transfer roller 70 sandwich the intermediate transfer belt 14 to form a secondary transfer nip. As mentioned above, the pair of registration rollers 55 pinches the transfer paper sheet P once, and then timely feeds the paper sheet P toward the secondary transfer nip so that the combined color toner image on the intermediate transfer belt 14 is transferred onto a predetermined position of the paper sheet P. Specifically, the entire combined color toner image is transferred due to a secondary transfer electric field formed by the secondary transfer roller 70, to which a secondary transfer bias is applied, and the secondary transfer backup roller 66, and a nip pressure applied between the secondary transfer roller 70 and the transfer backup roller 66, resulting in formation of a full color toner image on the paper sheet P having white color.

After passing the secondary transfer nip, the intermediate transfer belt 14 bears residual toners (i.e., non-transferred toners) on the surface thereof. The belt cleaning unit 162 removes the residual toners from the surface of the intermediate transfer belt 14. Specifically, a belt cleaning blade 162*a* of the belt cleaning unit 162 is contacted with the surface of the intermediate transfer belt 14 to remove the residual toners therefrom.

The first bracket 63 of the transfer unit 60 is rotated at a predetermined rotation angle on a rotation axis of the supplementary roller 68 by being driven by an on/off operation of a solenoid (not shown). When a monochromatic image is formed, the printer 500 slightly rotates the first bracket 63 counterclockwise by driving the solenoid. When the first bracket 63 is thus rotated, the primary transfer rollers 7Y, 7C and 7M are moved counterclockwise around the rotation axis of the supplementary roller 68, thereby separating the intermediate transfer belt 14 from the photoreceptors 3Y, 3C and 3M. Thus, only the black image forming unit 1K is operated (without driving the color image forming units 1Y, 1C and 1M) to form a monochromatic image. By using this method, the life of the parts of the color image forming units 1Y, 1C and 1M can be prolonged.

As illustrated in FIG. 2, a fixing unit 80 is provided above the secondary transfer nip. The fixing unit 80 includes a pressure/heat roller 81 having a heat source (such as a halogen lamp) therein, and a fixing belt unit 82. The fixing belt unit 82 includes an endless fixing belt 84 serving as a fixing member, a heat roller 83 having a heat source (such as a halogen lamp) therein, a tension roller 85, a driving roller 86, a temperature sensor (not shown), and the like. The endless fixing belt 84 is counterclockwise rotated endlessly by the driving roller 86 while being tightly stretched by the heat roller 83, the tension roller 85 and the driving roller 86. When the fixing belt 84 is rotated, the fixing belt is heated by the heat roller 83 from the backside thereof. The pressure/heat roller 81 is contacted with the front surface of the fixing belt 84 while pressing the fixing belt 84 to the heat roller 83, resulting in formation of a fixing nip between the pressure/heat roller 81 and the fixing belt 84.

A temperature sensor (not shown) is provided so as to be opposed to the front surface of the fixing belt 84 with a predetermined gap therebetween to detect the temperature of the fixing belt 84 at a location just before the fixing nip. The detection data are sent to a fixing device supply circuit (not shown). The fixing device supply circuit performs ON/OFF control on the heat source in the heat roller 83 and the heat source in the pressure/heat roller 81.

The transfer paper sheet P passing the secondary transfer nip and separated from the intermediate transfer belt 14 is fed to the fixing unit 80. When the paper sheet P bearing the unfixed full color toner image thereon is fed from the lower side of the fixing unit 80 to the upper side thereof while being sandwiched by the fixing belt 14 and the pressure/heat roller 81, the paper sheet P is heated by the fixing belt 84 while being pressed by the pressure/heat roller 81, resulting in fixation of the full color toner image on the paper sheet P.

The paper sheet P thus subjected to a fixing treatment is discharged from the main body of the printer 500 by a pair of discharging rollers 87 so as to be stacked on a surface of a stacking portion 88.

Four toner cartridges 100Y, 100C, 100M and 100K respectively containing yellow, cyan, magenta and black color toners are provided above the transfer unit 60 to supply the yellow, cyan, magenta and black color toners to the corresponding image developers 5Y, 5C, 5M and 5K of the image forming units 1Y, 1C, 1M and 1K, if desired. These toner cartridges 100Y, 100C, 100M and 100K are detachable from the main body of the printer 500 independently of the image forming units 1Y, 1C, 1M and 1K.

Next, the image forming operation of the printer 500 will be described.

Upon receipt of a print execution signal from an operating portion (not shown) such as an operation panel, predetermined voltages or currents are applied to the charging roller 4 and the developing roller 51 at predetermined times. Similarly, predetermined voltages or currents are applied to the light sources of the optical writing unit 40 and the discharging lamp. In synchronization with these operations, the photoreceptors 3 are rotated in a direction indicated by an arrow by a driving motor (not shown).

When the photoreceptors 3 are rotated, the surfaces thereof are charged by the respective charging rollers 4 so as to have predetermined potentials. Next, light beams L (such as laser beams) emitted by the optical writing unit 40 irradiate the charged surfaces of the photoreceptors 3, thereby forming electrostatic latent images on the surface of the photoreceptors 3.

The surfaces of the photoreceptors 3 bearing the electrostatic latent images are rubbed by magnetic brushes of the respective developers formed on the respective developing rollers 51. In this case, the (negatively-charged) toners on the developing rollers 51 are moved toward the electrostatic latent images by the development biases applied to the developing rollers 51, resulting in formation of color toner images on the surface of the photoreceptors 3Y, 3C, 3M and 3K.

Thus, each of the electrostatic latent images formed on the photoreceptors 3 is subjected to a reverse development treatment using a negative toner. In this example, an N/P (negative/positive: a toner adheres to a place having lower potential) developing method using a non-contact charging roller is used, but the developing method is not limited thereto.

The color toner images formed on the surfaces of the photoreceptors 3Y, 3C, 3M and 3K are primarily transferred to the intermediate transfer belt 14 so as to be overlaid, thereby forming a combined color toner image on the intermediate transfer belt 14.

The combined color toner image thus formed on the intermediate transfer belt 14 is transferred onto a predetermined portion of the paper sheet P, which is fed from the first or second cassette 151 or 152 and which is timely fed to the secondary transfer nip by the pair of registration rollers 55 after being pinched thereby. After the paper sheet P bearing the combined color toner image thereon is separated from the intermediate transfer belt 14, the paper sheet P is fed to the fixing unit 80. When the paper sheet P bearing the combined color toner image thereon passes the fixing unit 80, the combined toner image is fixed to the paper sheet P upon application of heat and pressure thereto. The paper sheet P bearing the fixed combined color toner image (i.e., a full color image) thereon is discharged from the main body of the printer 500, resulting in stacking on the surface of the stacking portion 88.

Toners remaining on the surface of the intermediate transfer belt 14 even after the combined color toner image thereon is transferred to the paper sheet P are removed therefrom by the belt cleaning unit 162.

Toners remaining on the surfaces of the photoreceptors 3 even after the color toner images thereon is transferred to the intermediate transfer belt 14 are removed therefrom by the cleaner 6. Further, the surfaces of the photoreceptors 3 are coated with a lubricant by the lubricant applicator 10, followed by a discharging treatment using a discharging lamp.

As illustrated in FIG. 3, the photoreceptor 3, the charging roller 4, the developing device 5, the cleaner 6, the lubricant applicator 10, and the like are contained in a case 2 of the image forming unit 1 of the printer 500. The image forming unit 10 is detachable attachable to the main body of the printer 500 as a single unit (i.e., process cartridge). However, the image forming unit 1 is not limited thereto, and may have a configuration such that each of the members and devices such as the photoreceptor 3, charging roller 4, developing device 5, cleaner 6, and lubricant applicator 10 is replaced with a new member or device.

Next, the toner for use in the printer 500 (i.e., the image forming apparatus of the present invention) will be described.

The toner is preferably a toner having a high circularity and a small particle diameter. Such a toner can be preferably prepared by polymerization methods such as suspension polymerization methods, emulsion polymerization methods, dispersion polymerization methods, and the like. The toner preferably has an average circularity not less than 0.97, and a volume-average particle diameter not greater than 5.5 μm to produce high resolution toner images.

The average circularity of the toner is measured using a flow particle image analyzer FPIA-2000 from Sysmex Corp. The procedure is as follows:

(1) initially, 100 to 150 ml of water, from which solid foreign materials have been removed, 0.1 to 0.5 ml of a surfactant (e.g., alkylbenzenesulfonate) and 0.1 to 0.5 g of a sample (i.e., toner) are mixed to prepare a dispersion;

(2) the dispersion is further subjected to a supersonic dispersion treatment for 1 to 3 minutes using a supersonic dispersion machine to prepare a dispersion including particles at a concentration of from 3,000 to 10,000 pieces/μl;

(3) the dispersion set in the analyzer so as to be passed through a detection area formed on a plate in the analyzer; and (4) the particles of the sample passing through the detection area are optically detected by a CCD camera and then the shapes of the toner particles and the distribution of the shapes are analyzed with an image analyzer to determine the average circularity of the sample.

Figure 4A:
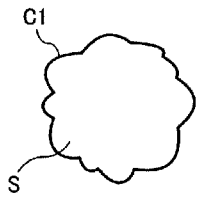
FIGS. 4A and 4B are schematic views for explaining the way to determine the circularity of toner.
Figure 4B:
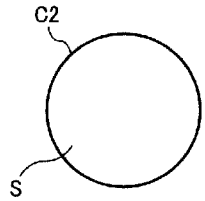

The method for determining the circularity of a particle will be described by reference to FIGS. 4A and 4B. When the projected image of a particle has a peripheral length C1 and an area S as illustrated in FIG. 4A, and the peripheral length of the circle having the same area S is C2 as illustrated in FIG. 4B, the circularity of the particle is obtained by the following equation.

$$\text{Circularity}=C2/C1$$

The average circularity of the toner is obtained by averaging circularities of particles.

The volume-average particle diameter of toner can be measured, for example, by an instrument such as COULTER MULTISIZER 2e manufactured by Beckman Coulter Inc. Specifically, the number-based particle diameter distribution data and the volume-based particle diameter distribution data are sent to a personal computer via an interface manufactured by Nikkaki Bios Co., Ltd. to be analyzed. The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl;

(2) 2 to 20 mg of a sample (toner) to be measured is added into the mixture;

(3) the subjected to an ultrasonic dispersion treatment for about 1 to 3 minutes; and (4) the dispersion is added to 100 to 200 ml of an aqueous solution of an electrolyte in a beaker so that the mixture includes the particles at a predetermined concentration;

(5) the diluted dispersion is set in the instrument to measure particle diameters of 50,000 particles using an aperture of 100 μm to determine the volume average particle diameter.

In this regard, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 to 40.30 μm are targeted.

In this regard, the volume average particle diameter is obtained by the following equation.

$$\text{Volume average particle diameter}=\Sigma XfV/\Sigma fV,$$

wherein X represent the representative particle diameter of each channel, V represents the volume of the particle having the representative particle diameter, and f represents the number of particles having particle diameters in the channel.

Figure 8:
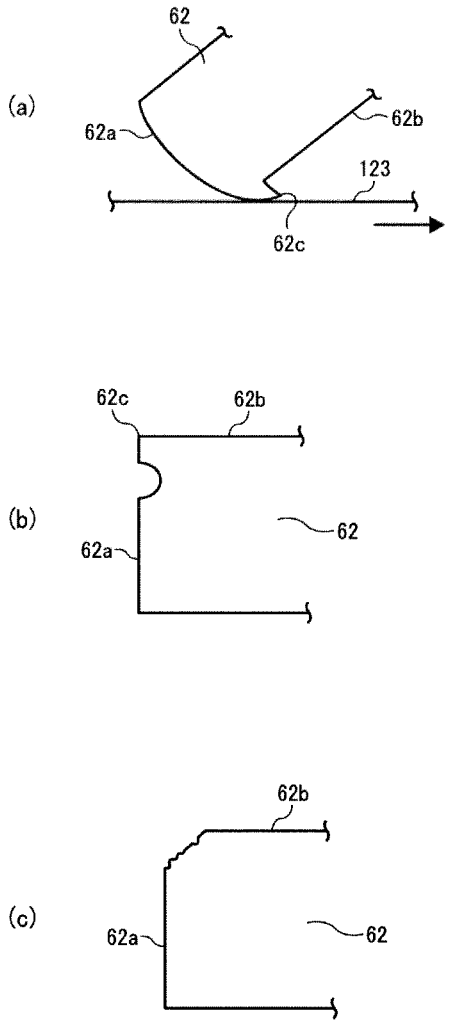
FIGS. 8(*a*) to 8(*c*) are schematic views for explaining how a cleaning blade is damaged.

When such a polymerization toner as mentioned above is used, residual toner remaining on the photoreceptor 3 cannot be satisfactorily removed therefrom using a cleaning blade compared to a case where a conventional pulverization toner is used, thereby easily forming an abnormal image in which background thereof is soiled with residual toner. In attempting to improve the cleanability (i.e., to prevent formation of such an abnormal image) by increasing the contact pressure of the cleaning blade 62 to the photoreceptor 3, another problem in that the cleaning blade is rapidly abraded is caused. In this case, friction between the cleaning blade 62 and the photoreceptor 3 is increased, and thereby the tip of the cleaning blade is pulled by the photoreceptor 3 in the moving direction of the photoreceptor as mentioned above by reference to FIG. 8(*a*). In this regard, the thus everted tip has a restoring force, and the tip tends to vibrate, resulting in generation of fluttering sounds. In addition, when the cleaning blade 62 in such a state is continuously used, the cleaning blade may lack the edge line thereof as illustrated in FIG. 8(*c*).

In the image forming apparatus of the present invention, a cleaning blade formed a strip-shaped elastic blade, a contact point of which to a photoreceptor includes a substrate of the elastic blade, a 1.0 μm thick mixed layer formed of the substrate and the acrylic and/or the methacrylic resin, and a 0.1 thick surface layer formed of the acrylic and/or the methacrylic resin is used as a such that both of the photoreceptor and the cleaning blade have high durability and the image forming apparatus produces quality images.

Figure 1B:
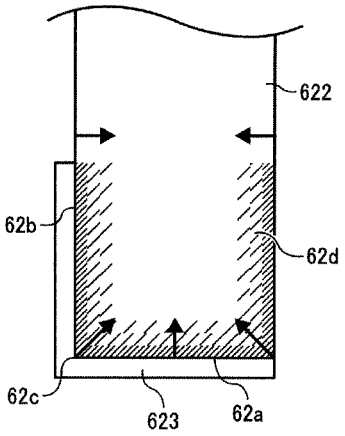
Figure 5:
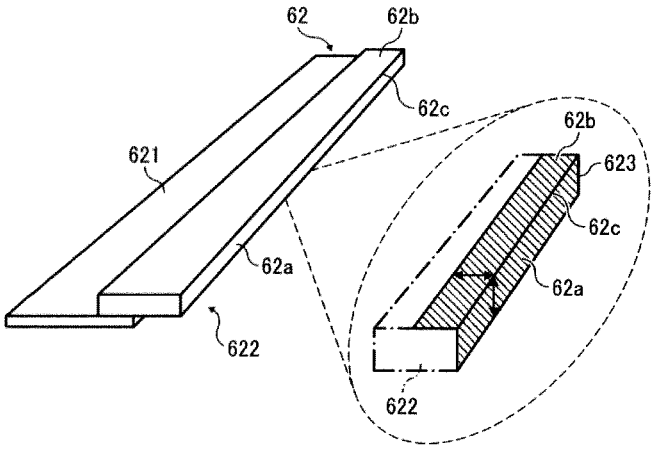
FIG. 5 is a schematic perspective view illustrating an example of the cleaning blade of this disclosure.

FIG. 5 is a perspective view illustrating an example of the cleaning blade of this application, and FIGS. 1A and 1B are enlarged cross-sectional views illustrating the cleaning blade. FIG. 1A illustrates the cleaning blade 62 contacted with a surface of the photoreceptor 3, and FIG. 1B is an enlarged cross-sectional view illustrating the tip of the cleaning blade 62. Referring to FIGS. 5, 1A and 1B, the cleaning blade 62 includes a strip-shaped holder 621 which is made of a rigid material such as metals and hard plastics, and a strip-shaped elastic blade 622. The elastic blade 622 has an edge line 62*c*, which is subjected to an impregnation treatment as mentioned below in detail. In addition, a surface layer 623 is formed on each of surfaces of a tip 62*a* and an upper portion of a lower surface 62*b* of the blade 62. As illustrated in FIG. 5, the surface layer 623 extends in the longitudinal direction of the blade 62.

The elastic blade 622 is fixed to an upper end portion of the holder 621, for example, by an adhesive. The other end portion (i.e., the lower end portion) of the holder 621 is supported (cantilevered) by a case of the cleaner 6.

In order that the elastic blade 622 can be satisfactorily contacted with the surface of the photoreceptor 3 even if the photoreceptor 3 is eccentric or the surface thereof is waved, the elastic blade 622 preferably has a high resilience coefficient. Typical synthetic rubbers such as an acrylic rubber, a nitrile rubber, an isoprene rubber, a urethane rubber, an ethylene propylene rubber, a chlorosulfonated polyethylene rubber, an epichlorohydrin rubber, a chloroprene rubber, a silicone rubber, a styrene-butadiene rubber, a butadiene rubber and a fluoro-rubber are used. Rubbers having a urethane group such as urethane rubbers are preferably used therefor.

The mixed layer 62*d* formed of the substrate and the acrylic and/or the methacrylic resin is formed by impregnating the elastic blade 622 with an acrylic and/or a methacrylic monomer using a coating method such as brush coating, spray coating and dip coating, and crosslinking the acrylic and/or a methacrylic monomer. The surface layer 623 formed of the acrylic and/or the methacrylic resin is formed by coating the edge line 62*c* of the cleaning blade 62 with the acrylic and/or a methacrylic monomer by spray coating, dip coating and screen printing, and crosslinking the acrylic and/or a methacrylic monomer. The acrylic and/or a methacrylic monomer is crosslinked when applied with an energy such as a heat, light and art electron beam.

Specific examples of the acrylic and/or methacrylic monomer for use in the present invention include trimethylolpropane triacrylate (TMPTA), trimethylolpropane trimethacrylate, trimethylolpropanealkylene-modified triacrylate, trimethylolpropaneethyleneoxy-modified (hereafter EO-modified) triacrylate, trimethylolpropanepropyleneoxy-modified (hereafter PO-modified) triacrylate, trimethylolpropanecaprolactone-modified triacrylate, trimethylolpropanealkylene-modified trimethacrylate, pentaerythritol triacrylate, pentaerythritol tetracrylate (PETTA), glycerol triacrylate, glycerol epichlorohydrin-modified (hereafter ECH-modified) triacrylate, glycerol EO-modified triacrylate, glycerol PO-modified triacrylate, tris(acryloxyethyl)isocyanurate, dipentaerythritol hexaacrylate (DPHA), dipentaerythritolcaprolactone-modified hexaacrylate, dipentaerythritolhydroxy pentaacrylate, alkylated dipentaerythritol pentacrylate, alkylated dipentaerythritol tetraacrylate, alkylated dipentaerythritol triacrylate, dimethylolpropane tetraacrylate (DTMPTA), pentaerythritolethoxy tetraacrylate, phosphoric acid EO-modified triacrylate, and 2,2,5,5-tetrahydroxymethylcyclopentanone tetracrylate. These can be used alone or in combination.

After the elastic blade 622 is impregnated with an acrylic and/or a methacrylic crosslinkable resin liquid, followed by natural drying for a predetermined period, the surface layer 623 is formed on the surface of the resin-impregnated portion of the blade using a method such as spray coating, dip coating, and screen printing to cover the edge line 62*c* and the surface of a tip portion of the elastic blade 622. Thus, the elastic blade 622 is impregnated with an acrylic and/or a methacrylic crosslinkable resin liquid to form a mixed layer 62*d* including the substrate and the acrylic and/or methacrylic resin at the surface thereof, and an acrylic and/or a methacrylic resin layer is formed then. A heat or a light energy may be applied after the elastic blade is impregnated with the acrylic and/or methacrylic crosslinkable resin liquid for a predetermined time or after the acrylic and/or methacrylic resin layer is formed to crosslink the resin.

The cleaning blade 62 can prevent the edge line 62*c* of the elastic blade 622 from deforming in a surface travel direction of the photoreceptor 3 because of the acrylic and/or methacrylic resin surface layer 623 contacting thereto. Further, even when the acrylic and/or methacrylic resin surface layer 623 is worn out and the substrate and the acrylic and/or methacrylic resin mixed layer 62*d* formed by impregnation treatment is exposed, the mixed layer can prevent the edge line 62*c* from deforming as well.

The thickness of the mixed layer 62*d* including the substrate and the acrylic and/or methacrylic resin can be controlled by the acrylic and/or methacrylic monomer, solvent, solid contents concentration, impregnation time, temperature, etc.

The mixed layer 62*d* including the substrate and the acrylic and/or methacrylic resin preferably has a thickness of from 5 to 100 μm, and more preferably from 10 to 30 μm. When too thin, the cleaning blade 62 is difficult to prevent the edge line 62*c* from deforming for long periods. When too thick, the cleaning blade has larger hardness to increase the load to a photoreceptor, resulting in increase of abrasion thereof and generation of fluttering sounds at low temperature. Further, the cleaning blade is likely to have a microscopic crack.

The substrate and the acrylic and/or methacrylic resin mixed layer 62*d* can be formed when the when the acrylic and/or methacrylic resin surface layer 623 is formed. In this case, the mixed layer 62*d* often has a thickness of the measurement limit or less. When having a thickness less than 1 μm, the substrate and the acrylic and/or methacrylic resin mixed layer 62*d* does not exert the effect of the present invention.

The thickness of the mixed layer including the substrate and the acrylic and/or methacrylic resin can be measured by a method disclosed in Japanese published unexamined application No. JP-2011-138110-A using microscopic IR.

The acrylic and/or methacrylic resin surface layer 623 can be formed while the blade is dipped in an acrylic and/or a methacrylic crosslinkable resin liquid for a predetermined time, but the layer occasionally has a thin thickness. Therefore, after dipped in the acrylic and/or methacrylic crosslinkable resin liquid for a predetermined time to form the mixed layer including the substrate and the acrylic and/or methacrylic resin, the acrylic and/or methacrylic crosslinkable resin liquid is preferably coated on the mixed layer to form the acrylic and/or methacrylic resin layer thereon.

The acrylic and/or methacrylic resin surface layer 623 is formed by coating the same acrylic and/or methacrylic monomers as those of the impregnating materials and applying an energy such as a heat, light and an electron beam.

The acrylic and/or methacrylic resin surface layer 623 preferably has a thickness of from 0.5 to 1.0 μm. When too thin, the cleaning blade does not have followability on the surface of a photoreceptor. When too thick, the cleaning blade edge has everted-tip and crack problems when used for long periods.

The thickness of the acrylic and/or methacrylic resin surface layer 623 can be measured by cutting the cross-section to take a picture thereof with a scanning electron microscope or a transmission electron microscope.

Thus, the edge line 62*c* of the cleaning blade 62 of the present invention has a layered structure including the substrate and the acrylic and/or methacrylic resin mixed layer 62*d* formed by impregnating the substrate of the elastic blade 622 with the acrylic and/or methacrylic resin, and the acrylic and/or methacrylic resin surface layer 623 harder than the elastic blade 622, located on the mixed layer 62*d*. This moderately prevents the edge line 62*c* from deforming against the surface of the photoreceptor 3 for long periods.

A composition including only the acrylic and/or methacrylic resin surface layer 623 harder than the elastic blade 622 without impregnating the substrate thereof with the acrylic and/or methacrylic resin is explained. Even the surface layer 623 is abraded as time passes. When the surface layer 623 is made thicker against long-term use, elastic deformation of the edge line 62*c* of the elastic blade 622 is impaired, possibly resulting in poor cleaning. When the surface layer 623 is made thinner so as not to impair the elastic deformation of the edge line 62*c* of the elastic blade 622, the surface layer 623 is abraded to expose the substrate in a short time. When the substrate having low hardness directly contacts the surface of the photoreceptor 3, a friction coefficient between the cleaning blade 62 and the photoreceptor 3 becomes large, resulting in excessive abrasion and abnormal noises.

The cleaning blade 62 of the present invention includes the mixed layer 62*d* including the substrate of the elastic blade 622 and the acrylic and/or methacrylic resin on the inside of the acrylic and/or methacrylic resin surface layer 623 having high hardness. This moderately reinforces mechanical strength and stiffness of an elastic (urethane) rubber as the substrate, moderately prevents behavior of the blade edge against the surface of the photoreceptor 3 to be cleaned well, and prevents the excessive abrasion and abnormal noises to have high abrasion resistance.

When only a surface layer having high hardness is formed on the elastic blade 622, hardness drastically changes at a border of the surface layer and the substrate layer and a stress is concentrated thereon, possibly resulting in damage of the elastic blade 622. When the substrate of the elastic blade 622 is impregnated with the acrylic and/or methacrylic resin to form the substrate and the acrylic and/or methacrylic resin mixed layer 62*d*, it prevents the hardness from drastically changing at a border of the surface layer and the substrate layer to prevent the elastic blade 622 from being damaged due to the concentration of stress.

Further, the acrylic and/or the methacrylic resin used in the surface layer have better durability than resins having conventionally been used. In addition, since both of the surface layer and the mixed layer include the acrylic and/or the methacrylic resin, the acrylic and/or the methacrylic resin of the mixed layer exert a so-called anchor effect to those of the surface layer, and it is thought an adhesion between the surface layer and the elastic blade is increased. This is thought to further improve the durability of the surface layer. Furthermore, since the acrylic and/or the methacrylic resin used to form the mixed layer perform crosslink reaction without chemically bonding with the elastic blade differently from a conventionally-used isocyanate compound, it is not thought the elastic blade deteriorate in elasticity due to too high crosslink density of the mixed layer.

Next, the photoreceptor 3 used in the present invention is explained. The photoreceptor 3 includes at least a photosensitive layer 92 on an electroconductive substrate 91, and the photosensitive layer 92 includes a particulate material dispersed in a resin at the surface.

First, layer structures of the photoreceptor used in the present invention is explained.

Figure 9A:
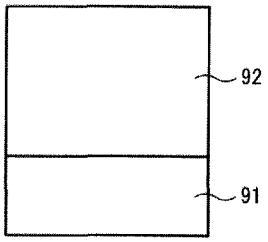
FIGS. 9A to 9D are schematic views illustrating examples of photosensitive layer of photoreceptors use in the image forming apparatus of the present invention.
Figure 9B:
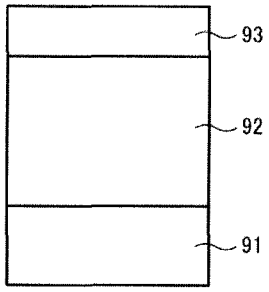
Figure 9C:
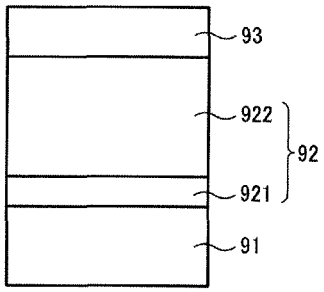
Figure 9D:
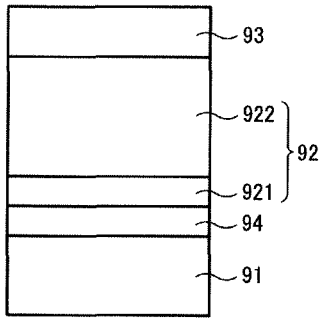

FIG. 9A is an examples of the layer structures thereof including an electroconductive substrate 91 and a photosensitive layer 92 including an inorganic particulate material at the surface thereon. FIG. 9B is an examples of the layer structures thereof including an electroconductive substrate 91, and a photosensitive layer 92 and a surface layer 93 including an inorganic particulate material thereon. FIG. 9C is an examples of the layer structures thereof including an electroconductive substrate 91, and a photosensitive layer 92 including a charge generation layer 921 and a charge transport layer 922 and a surface layer 93 including an inorganic particulate material thereon. FIG. 9D is an example of the layer structures thereof including an electroconductive substrate 91, and an undercoat layer 94, a photosensitive layer 92 including a charge generation layer 921 and a charge transport layer 922 and a surface layer 93 including an inorganic particulate material thereon.

The photoreceptor 3 used in the present invention includes at least an electroconductive substrate 91 and a photosensitive layer 92 including a particulate material dispersed in a resin at the surface thereon, and may include other layers.

Suitable materials for use as the electroconductive substrate 91 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can be also used as the substrate.

Furthermore, substrates, in which a coating liquid including a binder resin and an electroconductive powder is coated on the supporters mentioned above, can be used as the substrate 91. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can be also used as the substrate 91.

Next, the photosensitive layer 92 of the present invention is explained.

In the present invention, the photosensitive layer may be single-layered or a multi-layered. At first, the multi-layered photosensitive layer including the charge generation layer (CGL) 921 and the charge transport layer (CTL) 922 in FIG. 9C is explained.

The CGL 921 is a layer including a charge generation material (CGM) as the main component. Known CGMs can be used in the CGL 921. Specific examples of the CGM so include, but are not limited to, monoazo pigments, disazo pigments, trisazo pigments, perylene pigments, perynone pigments, quinacridone pigments, quinone type condensed polycyclic compounds, squaric acid type dyes, other phthalocyanine pigments, naphthalocyanine pigments, azulenium salt dyes, etc. These CGMs can be used alone or in combination.

In the present invention, particularly an azo pigment and/or a phthalocyanine pigment are effectively used, Particularly, an azo pigment having the following formula (I) and titanyl phthalocyanine pigment having a CuKα 1.542 Å X-ray diffraction spectrum including a maximum diffraction peak at least at a Bragg (2θ) angle of 27.2° are effectively used.

A weight ratio of the binder resin to the CGM is typically from 0 to 500, and preferably from 10 to 300 parts by weight per 100 parts by weight of the CGM.

Specific examples of the solvents include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. In particular, ketone type solvents, ester type solvents and ether type solvents are preferably used.

Specific examples of methods of coating a coating liquid include, but are not limited to, dip coating methods, spray coating methods, bead coating methods, nozzle coating methods, spinner coating methods, ring coating methods, etc.

The CGL 921 typically has a thickness of from 0.01 to 5 μm, and preferably from 0.1 to 2 μm.

The CTL 922 is formed by coating a coating liquid in which a charge transport material (CTM) is dissolved or dispersed with a binder resin in a solvent on the CGL 921 formed on the electroconductive substrate 91.

The CTL 922 may include a plasticizer, a leveling agent and an antioxidant when necessary.

The CTM includes a positive hole transport material and an electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, benzoquinone derivatives, etc.

Specific examples of the positive hole transport materials include poly(N-carbazole) and its derivatives, poly(γ-carbazolylethylglutamate) and its derivatives, pyrene-formaldehyde condensation products and their derivatives, polyvinyl pyrene, polyvinyl phenanthrene, polysilane, oxazole derivatives, oxadiazole derivatives, imidazole derivatives,

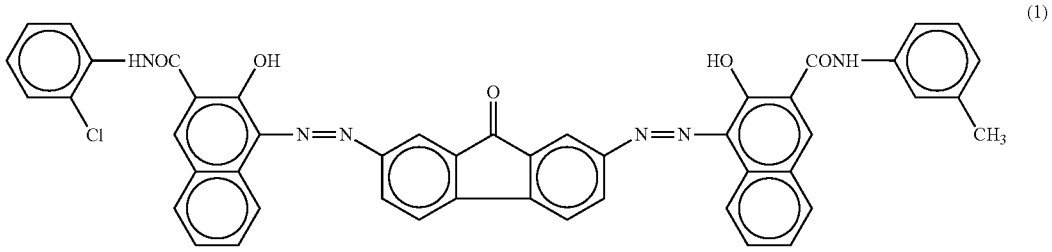

(1)

The CGL 921 is formed by coating a coating liquid in which the CGM is dispersed in a solvent with a binder resin when necessary on the electroconductive substrate 91 and drying the liquid.

Specific examples of the binder resin used in the CGL 921 when necessary include, but are not limited to, polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, etc.

monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These can be used alone or in combination.

Specific examples of the binder resin include, but are not limited to, thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, acrylic resins, silicone resins, epoxy resins, melamine resins, urethane resins, phenolic resins and alkyd resins. A weight ratio of the CTM to the binder resin is from 20 to 300, and preferably from 40 to 150 parts by weight per 100 parts by weight of the binder resin.

The CTL 922 preferably has a thickness of 25 μm or less because of image resolution and response.

Specific examples of the solvent include, but are not limited to, tetrahydrofuran, dioxane, toluene, dichloromethane, monochlorobenzene, dichloroethane, cyclohexanone, methyl ethyl ketone, acetone, etc.

The CTL 922 may further include a plasticizer and a leveling agent. Specific examples of the plasticizer include, but are not limited to, dibutylphthalate and dioctylphthalate, etc. The CTL 922 preferably includes the plasticizer in an amount of from 0 to 30% by weight based on total weight of the binder resin.

Specific examples of the leveling agents include, but are not limited to, silicone oil such as dimethylsilicone oil and methylphenyls one oil; and polymers and oligomers having a perfluoroalkyl group in the side chain. The CTL 922 preferably includes the leveling agent in an amount of from 0 to 1% by weight based on total weight of the binder resin.

Next, a single-layered photosensitive layer 92 in FIG. 9B is explained. The CGMs and the CTMs mentioned above can be used. The single-layered photosensitive layer 92 can be formed by coating a coating liquid in which a CGM, a CTM and a binder resin are dissolved or dispersed in a proper solvent, and then drying the coated liquid.

In addition, the photosensitive layer 92 may optionally include additives such as plasticizers, leveling agents and antioxidants. Suitable binder resins include the resins mentioned above in the CTL 922. The resins mentioned above in the CGL can be added as a binder resin. The photosensitive layer 92 preferably includes a CGM in an amount of from 5 to 40 parts by weight, and a CTM in an amount of from 0 to 190, and more preferably from 50 to 150 parts by weight based on total weight of the binder resin.

The single-layered photosensitive layer 92 can be formed by coating a coating liquid in which a CGM, a binder resin and a CTM are dissolved or dispersed in a solvent such as tetrahydrofuran, dioxane, dichloroethane, cyclohexane, etc. by a coating method such as a dip coating method, spray coating method, a bead coating method and a ring coating method. The thickness of the photosensitive layer is preferably from 5 to 25 μm.

In the photoreceptor of the present invention, an undercoat layer 94 may be formed between the substrate 91 and the photosensitive layer 92. FIG. 9D is a composition in which an undercoat layer is formed between the electroconductive substrate 91 and the CGL 921 in FIG. 9C. The undercoat layer 94 includes a resin as a main component. Since the photosensitive layer 94 is typically formed on the undercoat layer by coating a liquid including an organic solvent, the resin in the undercoat layer preferably has good resistance against general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network structure such as polyurethane resins, melamine resins, alkyd-melamine resins, epoxy resins and the like.

The undercoat layer 94 may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer 94 can be formed by coating a coating liquid using a proper solvent and a proper coating method similarly to those for use in formation of the photosensitive layer 92 mentioned above.

The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Other than these, known materials can be used.

The undercoat layer preferably has a thickness of from 0 to 5 μm.

The photoreceptor 3 includes a surface layer 93 including a particulate material on the single-layered or multi-layered photosensitive layer 92. The surface layer 93 is formed at least a particulate material and a binder resin. Specific examples of the binder resin include thermoplastic resins such as a polyarylate resin and a polycarbonate resin and crosslinkable resins such as a urethane resin and a phenol resin. Specific examples of the particulate material include organic or inorganic particulate materials. Specific examples of the organic particulate materials include a fluorine-containing particulate resin and a particulate diamond. Specific examples of the inorganic particulate materials include metallic powders such as copper, tin, aluminum and indium; oxides such as silicon oxide, silica, tin oxide, zinc oxide, titanium oxide, indium oxide, antimony oxide, bismuth oxide, antimony-doped tin oxide and tin-doped indium oxide; and potassium titanate. Particularly, the oxides are preferably used, and the silicon oxide, the aluminum oxide, and the titanium oxide are effectively used.

The surface layer 93 preferably has a thickness of from 1 to 8.0 μm. The photoreceptor 3 which is repeatedly used for long periods preferably has high mechanical durability abrasion resistance. However, ozone or NOx gas is generated from a charger or the like members in apparatus and adheres to the surface of the photoreceptor, resulting in image distortion. In order to prevent this, the photoreceptor needs to be abraded at not less than a specific speed. In consideration of this, the surface layer 93 preferably has a thickness not less than 1.0 μm. When greater than 8.0 μm, increase of a residual potential and deterioration of fine dot reproducibility are thought to occur.

The higher the concentration of the particulate material in the surface layer, the higher the abrasion resistance. However, when the concentration is too high, a residual potential increases and a writing light transmittance of the surface layer deteriorates. Therefore, the particulate material preferably has a concentration not greater than 50% by weight, and more preferably not greater than 30% by weight based on total weight of solid contents in the surface layer. The minimum is 5% by weight.

Further, a surface of the inorganic particulate material is preferably treated with a surface treatment agent to improve dispersibility thereof. The dispersibility deterioration of the inorganic particulate material causes not only an increase of a residual potential but also transparency deterioration of the surface layer and a defect thereof, and further deterioration of the abrasion resistance thereof. Therefore, it is probable that the dispersibility deterioration of the inorganic particulate material will be a serious problem impairing a high durability of the resultant photoreceptor or high-quality images produced thereby. Specific examples of the surface treatment agent include any conventional surface treatment agents, but they preferably can maintain an insulation of the inorganic particulate material. Specific examples thereof include titanate coupling agents, aluminium coupling agents, zircoaluminate coupling agents, higher fatty acids and mixtures of each agent with a silane coupling agents; and $AL_2O_3$, $TiO_2$, $ZRO_2$, silicone, aluminium stearate and their mixtures. These are preferably used to improve dispersibility of the inorganic particulate material and prevent blurred images. The silane coupling agents occasionally causes blurred images, but a mixture of the surface treatment agent and the silane coupling agent occasionally can prevent the influence. Although an amount of the surface treatment agent depends on the primary particle diameter of an inorganic particulate material, the amount thereof is preferably from 3 to 30% by weight, and more preferably from 5 to 20% by weight base on total weight of the inorganic particulate material. When less than 3% by weight, the inorganic particulate material is not well dispersed. When greater than 30% by weight, a residual potential significantly increases. These inorganic particulate materials can be used alone or in combination.

The inorganic particulate material can be dispersed by proper dispersers. The inorganic particulate material has an average particle diameter not greater than 1 μm, and preferably not greater than 0.5 μm in terms of transmission of the surface layer 93.

The surface layer 93 is formed on the photosensitive layer 92 by a dip coating method, a ring coat method or a spray coating method. Typically, the spray coating method discharging a coating liquid from a nozzle having a microscopic opening and atomizing the liquid to from microscopic droplets to adhere onto the photosensitive layer 92 is used. Specific examples of solvents used in the coating liquid include tetrahydrofuran, dioxane, toluene, dichloromethane, monochlorobenzene, dichloroethane, cyclohexanone, methyl ethyl ketone, acetone, etc.

The surface layer 93 may include a charge transport material to reduce residual potential and improve response. The charge transport materials mentioned in the description of the charge transport layer can be used. When a low-molecular-weight charge transport material is used, the low-molecular-weight charge transport material may have a concentration gradient in the surface layer 93. A polymeric charge transport material having charge transportability and capability as a binder resin is preferably used as well in the surface layer 93. The surface layer 93 including the polymeric charge transport material has good abrasion resistance. Known materials can be used as the polymeric charge transport material, and at least one polymer selected from the group consisting of polycarbonate, polyurethane, polyester and polyether. Particularly, polycarbonate including a triarylamine structure in a main chain and/or a side chain is preferably used.

The photoreceptor 3 may have the photosensitive layer 92 including a charge transport layer 922 as an outermost layer including a particulate material. Specific examples of the particulate material include organic or inorganic particulate materials. Specific examples of the organic particulate materials include a fluorine-containing particulate resin and a particulate diamond. Specific examples of the inorganic particulate materials include metallic powders such as copper, tin, aluminum and indium; oxides such as silicon oxide, silica, tin oxide, zinc oxide, titanium oxide, indium oxide, antimony oxide, bismuth oxide, antimony-doped tin oxide and tin-doped indium oxide; and potassium titanate. Particularly, the oxides are preferably used, and the silicon oxide, the aluminum oxide, and the titanium oxide are effectively used.

The higher the concentration of the inorganic particulate material in the surface layer, the higher the abrasion resistance. However, when the concentration is too high, a residual potential increases and a writing light transmittance of the surface layer deteriorates. Therefore, the particulate material preferably has a concentration not greater than 30% by weight, and more preferably not greater than 20% by weight based on total weight of solid contents in the surface layer. The minimum is 3% by weight. Further, a surface of the inorganic particulate material is preferably treated with a surface treatment agent to improve dispersibility thereof. The dispersibility deterioration of the inorganic particulate material causes not only an increase of a residual potential but also transparency deterioration of the surface layer and a defect thereof, and further deterioration of the abrasion resistance thereof. Therefore, it is probable that the dispersibility deterioration of the inorganic particulate material will be a serious problem impairing a high durability of the resultant photoreceptor or high-quality images produced thereby.

Further, as FIG. 9A shows, a single-layered photosensitive layer 92 may be an outermost layer including a particulate material.

The surface layer 93 preferably has a Martens hardness not less than 190N/mm$^2$ and an elastic power ratio (We/Wt value) not less than 37.0% for the purpose of maintaining the followability of the cleaning blade on the photoreceptor for long periods. The Martens hardness and the elastic power ratio are measured under the following conditions.

Measurer: Fischerscope H-100
Test method: Load an unload repeat (once) test
Indenter: Micro Vickers indenter
Max. load: 9.8 mN
Load (unload) time: 30 sec
Hold time: 5 sec When the Martens hardness is less than 190N/mm$^2$, a toner is fixed on the surface of the photoreceptor. When the elastic power ratio (We/Wt value) is less than 37.0%, the three-dimensional network structure in the surface layer does not have sufficient durability. When an image area ratio in an axial direction of the photoreceptor, an abrasion speed thereof changes, resulting in uneven abrasion. Therefore, the content of the inorganic particulate material and the resin control the hardness and the elastic power ratio. Resins such as polycarbonate and polyarylate improve the hardness and the elastic power ratio because of having stiff structure in the resin skeleton. Further, a polymeric charge transport material improves the hardness and the elastic power ratio as well.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

<Preparation of Cleaning Blade>

Cleaning blades 1 to 29 were prepared using the following elastic blades 622; the substrate and the acrylic and/or methacrylic resin mixed layer 62*d*, the impregnation time and the thickness; and the acrylic and/or methacrylic resin surface layer 623 and the thickness.

(Elastic Blade)

The following materials were used for the elastic blade 622.

| Material | Hardness (°) at 25° C. | Resilience coefficient (%)at 25° C. | Manufacturer |
|---|---|---|---|
| Urethane rubber 1 | 66 | 46 | Bando Chemical Industries, Ltd. |
| Urethane rubber 2 | 70 | 50 | Toyo Tire & Rubber Co., Ltd. |
| Urethane rubber 3 | 72 | 31 | Toyo Tire & Rubber Co., Ltd. |
| Urethane rubber 4 | 75 | 21 | Toyo Tire & Rubber Co., Ltd. |
| Urethane rubber 5 | 77 | 19 | Synztec Co., Ltd. |

The hardness of the urethane rubbers 1-5 was measured by a method defined in JIS K6253 using a durometer manufactured by Shimadzu Corp. When measuring the hardness, sheets (with a thickness of about 2 mm) of each of the urethane rubbers were overlaid so that the rubber has a thickness of not less than 12 mm.

The resilience coefficient of the urethane rubbers 1-5 was measured by a method defined in JIS K6255 using a resilience tester No. 221 manufactured by Toyo Seiki Seisaku-Sho Ltd. When measuring the resilience coefficient, sheets (with a thickness of about 2 mm) of each of the urethane rubbers were overlaid so that the rubber has a thickness of not less than 4 mm.

A strip-shaped elastic blade 622 having a thickness of 1.8 mm was formed from the urethane rubber. The elastic blade was subjected to the following processes to form a substrate and an acrylic and/or a methacrylic resin mixed layer 62*d* and an acrylic and/or a methacrylic resin surface layer 623.

(Mixed Layer Forming Material)

The elastic blade 622 was dipped in the following mixed layer forming material liquid for a predetermined time to form a substrate and an acrylic and/or a methacrylic resin mixed layer 62*d*. The layer is crosslinked with a heat energy and an optical energy after an acrylic and/or a methacrylic resin surface layer is formed.

| <Mixed Layer Material 1> | |
|---|---|
| Monomer: PETIA (from DAICEL-CYTEC Co., Ltd.) | 10 parts |
| Polymerization initiator (IRGACURE 184 from Ciba Specialty Chemicals) | 1 part |
| Solvent: Tetrahydrofuran | 149 parts |
| <Mixed Layer Material 2> | |
| Monomer 1: PETIA (from DAICEL-CYTEC Co., Ltd.) | 9 parts |
| Monomer 2: HDDA (from DAICEL-CYTEC Co., Ltd.) | 1 part |
| Polymerization initiator (IRGACURE 184 from Ciba Specialty Chemicals) | 1 part |
| Solvent: Tetrahydrofuran | 149 parts |
| <Mixed Layer Material 3> | |
| Monomer: DPHA (from DAICEL-CYTEC Co., Ltd.) | 10 parts |
| Polymerization initiator (IRGACURE 184 from Ciba Specialty Chemicals) | 1 part |
| Solvent: Tetrahydrofuran | 149 parts |
| <Mixed Layer Material 4> | |
| Monomer: DPCA-120 (from Nippon Kayaku Co., Ltd.) | 10 parts |
| Polymerization initiator (IRGACURE 184 from Ciba Specialty Chemicals) | 1 part |
| Solvent: Tetrahydrofuran | 149 parts |
| <Mixed Layer Material 5> | |
| Monomer 1: SUMIJULE HT <HDI adduct> (from Sumika Bayer Urethane Co., Ltd.) | 8 parts |

-continued

| | |
|---|---|
| Monomer 2: Polyol having the following formula (from KANTO CHEMICAL CO., INC.) | 2 parts |

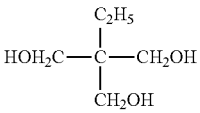

| | |
|---|---|
| Solvent: Tetrahydrofuran | 110 parts |

(Blade Surface Layer Forming Material)

The following surface layer forming material liquid was sprayed on the substrate and acrylic and/or a methacrylic resin mixed layer 62*d* to form an acrylic and/or a methacrylic resin surface layer 623 thereon. The surface layer forming materials 1 to 4 were irradiated with UV light to be optically crosslinked. The surface layer forming material 5 was heated to be thermally crosslinked. The surface layer thickness was controlled by the spray coating conditions such as a spray amount and a coating speed.

| <Surface Layer Material 1> | |
|---|---|
| Monomer: PETIA from DAICEL-CYTEC Co., Ltd. | 10 parts |
| Polymerization initiator IRGACURE 184 from Ciba Specialty Chemicals | 1 part |
| Solvent: 2-butanone | 89 parts |
| <Surface Layer Material 2> | |
| Monomer 1: PETIA from DAICEL-CYTEC Co., Ltd. | 9 parts |
| Monomer 2: HDDA from DAICEL-CYTEC Co., Ltd. | 1 part |
| Polymerization initiator IRGACURE 184 from Ciba Specialty Chemicals | 1 part |
| Solvent: 2-butanone | 89 parts |
| <Surface Layer Material 3> | |
| Monomer: DPHA from DAICEL-CYTEC Co., Ltd. | 10 parts |
| Polymerization initiator IRGACURE 184 from Ciba Specialty Chemicals | 1 part |
| Solvent: 2-butanone | 89 parts |
| <Surface Layer Material 4> | |
| Monomer: DPCA-120 (from Nippon Kayaku Co., Ltd.) | 10 parts |
| Polymerization initiator (IRGACURE 184 from Ciba Specialty Chemicals) | 1 part |
| Solvent: 2-butanone | 89 parts |
| <Surface Layer Material 5> | |
| Monomer 1: SUMIJULE HT <HDI adduct> (from Sumika Bayer Urethane Co., Ltd.) | 8 parts |
| Monomer 2: Polyol having the following formula (from KANTO CHEMICAL CO., INC.) | 2 parts |

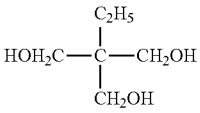

| | |
|---|---|
| Solvent: 2-butanone | 70 parts |

<Optical Crosslink Conditions>

UV irradiation: Metal Halide Lamp (from USHIO INC)

Irradiation intensity: 500 mW/cm$^2$ (365 nm)

UV lamp-blade distance: 100 mm

Irradiation time: 60 sec

<Thermal Crosslink Conditions>

Heating temperature: 150° C.

Heating time: 20 min

The thus prepared cleaning blades 1 to 29 are shown in Table 1

TABLE 1

| Blade | Base Blade | Mixed Layer Material | Mixed Layer Time s | Mixed Layer Thickness μm | Surface Layer Material | Surface Layer Thickness μm |
|---|---|---|---|---|---|---|
| Blade 1 | 2 | 1 | 5 | 5 | 1 | 0.8 |
| Blade 2 | 2 | 1 | 8 | 9 | 1 | 0.8 |
| Blade 3 | 2 | 1 | 11 | 11 | 1 | 0.8 |
| Blade 4 | 2 | 1 | 20 | 15 | 1 | 0.8 |
| Blade 5 | 2 | 1 | 30 | 20 | 1 | 0.8 |
| Blade 6 | 2 | 1 | 55 | 29 | 1 | 0.8 |
| Blade 7 | 2 | 1 | 75 | 32 | 1 | 0.8 |
| Blade 8 | 2 | 1 | 120 | 41 | 1 | 0.8 |
| Blade 9 | 2 | 1 | 1800 | 92 | 1 | 0.8 |
| Blade 10 | 2 | 1 | 3600 | 103 | 1 | 0.8 |
| Blade 11 | 1 | 1 | 30 | 20 | 1 | 0.8 |
| Blade 12 | 3 | 1 | 30 | 20 | 1 | 0.8 |
| Blade 13 | 4 | 1 | 30 | 20 | 1 | 0.8 |
| Blade 14 | 5 | 1 | 30 | 20 | 1 | 0.8 |
| Blade 15 | 3 | 1 | 30 | 20 | 1 | 0.4 |
| Blade 16 | 3 | 1 | 30 | 20 | 1 | 0.6 |
| Blade 17 | 3 | 1 | 30 | 20 | 1 | 0.9 |
| Blade 18 | 3 | 1 | 30 | 20 | 1 | 1.2 |
| Blade 19 | 3 | 2 | 30 | 20 | 2 | 0.8 |
| Blade 20 | 3 | 3 | 30 | 15 | 3 | 0.8 |
| Blade 21 | 3 | 4 | 30 | 15 | 4 | 0.8 |
| Blade 22 | 3 | 3 | 30 | 15 | 1 | 0.8 |
| Blade 23 | 3 | 5 | 30 | 30 | 5 | 0.8 |
| Blade 24 | 2 | 1 | 30 | 20 | 1 | 0.05 |
| Blade 25 | 2 | 1 | 0 | 0.2 | 1 | 0.8 |
| Blade 26 | 3 | 1 | 30 | 20 | 1 | 0.05 |
| Blade 27 | 3 | 1 | 0 | 0.2 | 1 | 0.8 |
| Blade 28 | 2 | — | — | — | — | — |
| Blade 29 | 3 | — | — | — | — | — |

<Preparation of Photoreceptor>

Photoreceptors 1 to 6 were prepared under the following conditions.

[Substrate]

An aluminum cylinder having an outer diameter of 40 mm was used as a substrate to prepare a photoreceptor.

[Undercoat Layer]

An undercoat layer coating liquid having the following formulation was coated on the substrate by dip coating method to form an undercoat layer 94 having a thickness of 3.5 μm thereon.

Alkyd resin: Beckosol 1307-60-EL from DIC Corporation

Melamine resin: Super Beckamine G-821-60 from DIC Corporation

Titanium oxide: CR-EL from Ishihara Sangyo Kaisha Ltd.

Methyl Ethyl Ketone

Mixing ratio (weight): alkyd resin/melamine resin/titanium oxide/methyl ethyl ketone 3/2/20/100

[CGL]

A CGL coating liquid having the following formulation was coated on the undercoat layer by dip coating method, and heated to be dry to form a CGL having a thickness of 0.2 μm thereon.

Bisazo pigment having the following formula:

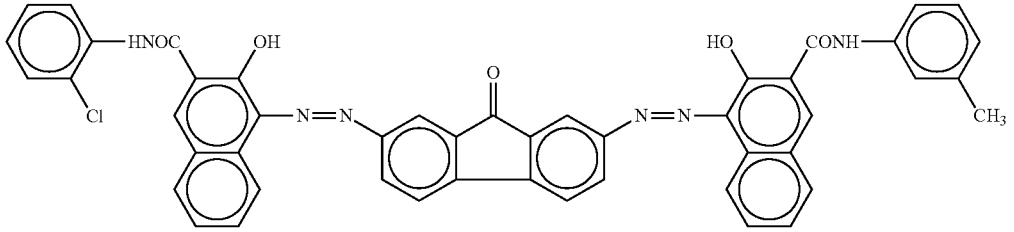

Polyvinyl butyral (XYHL from Union Carbide Corp.)

2-Butanonecyclohexanone

Mixing ratio (weight): bisazo pigment/polyvinylbutyral/2-butanonecyclohexanone=5/1/100/200

[CTL]

A CTL coating liquid having the following formulation was coated on the CGL by dip coating method, and heated to be dry to form a CTL having a thickness of 22 μm thereon.

Bisphenol Z-type polycarbonate (CTM) having the following formula (3).

(3)

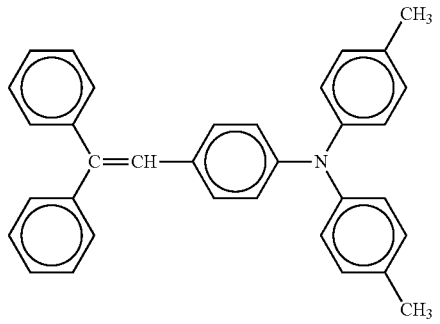

Tetrahydrofuran

Mixing ratio (weight): polycarbonate/CTM/tetrahydrofuran=1/1/10

[Surface Layer 1]

A surface layer coating liquid 1 having the following formulation was sprayed on the CTL, and heated to be dried at 150° for 20 min to prepare a photoreceptor 1.

(Coating Liquid for Surface Layer 1)

CTM having the formula (3)

Bisphenol Z-type polycarbonate (TS-2050 from Teijin Chemicals Ltd.)

Particulate silica (KPX100 from Shin-Etsu Chemical Co., Ltd.)

Tetrahydrofuran

Cyclohexanone

Mixing ratio (weight): CTM/polycarbonate/particulate silica/tetrahydrofuran/cyclohexanone=3/4/3/170/50

[Surface Layer 2]

A surface layer coating liquid 2 having the following formulation was sprayed on the CTL, and heated to be dried at 150° for 20 min to prepare a photoreceptor 2.

(Coating Liquid for Surface Layer 2)

CTM having the formula (3)

Bisphenol Z-type polycarbonate (TS-2050 from Teijin Chemicals Ltd.)

Particulate alumina (AA-05 from Sumitomo Chemical Co., Ltd.)

Tetrahydrofuran

Cyclohexanone

Mixing ratio (weight): CTM/polycarbonate/particulate alumina/tetrahydrofuran/cyclohexanone=3/4/3/170/50

[Surface Layer 3]

A surface layer coating liquid 3 having the following formulation was sprayed on the CTL, and heated to be dried at 150° for 20 min to prepare a photoreceptor 3.

(Coating Liquid for Surface Layer 3)

CTM having the formula (3)

Bisphenol Z-type polycarbonate (TS-2050 from Teijin Chemicals Ltd.)

Particulate alumina (AA-05 from Sumitomo Chemical Co., Ltd.)

Tetrahydrofuran

Cyclohexanone

Mixing ratio (weight): CTM/polycarbonate/particulate alumina/tetrahydrofuran/cyclohexanone=3/6/1/170/50

[Surface Layer 4]

A surface layer coating liquid 4 having the following formulation was sprayed on the CTL, and heated to be dried at 150° for 20 min to prepare a photoreceptor 4.

(Coating Liquid for Surface Layer 4)

CTM having the formula (3)

Polycarbonate having the following formula (4) having a viscosity-average molecular weight of 56,000

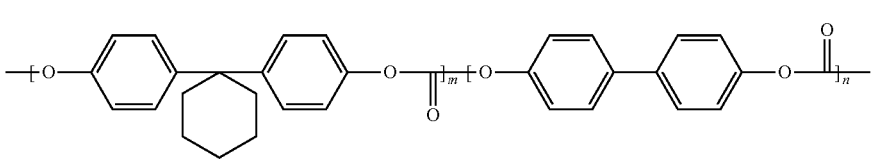

(4)

wherein m is 5.8 and n is 4.2.

Particulate alumina (AA-05 from Sumitomo Chemical Co., Ltd.)

Tetrahydrofuran

Cyclohexanone

Mixing ratio (weight): CTM/polycarbonate/particulate alumina/tetrahydrofuran/cyclohexanone 3/6/1/170/50

[Surface Layer 5]

A surface layer coating liquid 4 having the following formulation was sprayed on the CTL, and heated to be dried at 150° for 20 min to prepare a photoreceptor 5.

(Coating Liquid for Surface Layer 5)

Polymeric CTM having the following formula (5) having a viscosity-average molecular weight of 65,000

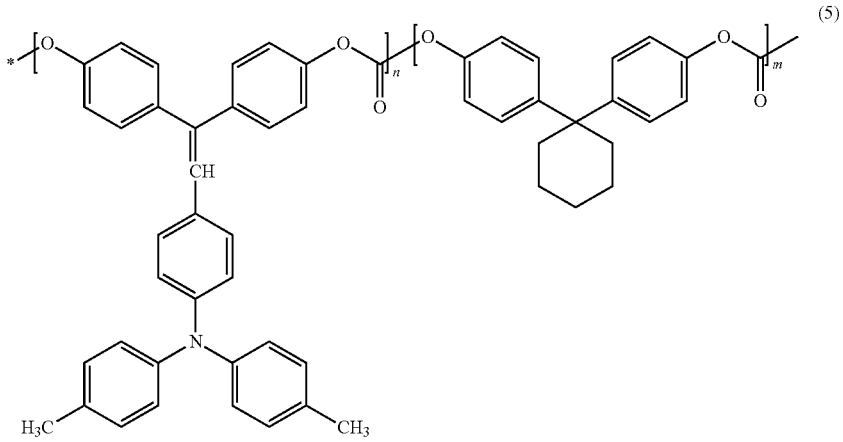

(5)

wherein m is 3.2 and n is 2.3.

Particulate alumina (AA-05 from Sumitomo Chemical Co., Ltd.)

Tetrahydrofuran

Cyclohexanone

Mixing ratio (weight): polymeric CTM/polycarbonate/particulate alumina/tetrahydrofuran/cyclohexanone=7/3/1/170/50

[Surface Layer 6]

A surface layer coating liquid 6 having the following formulation was sprayed on the CTL, and heated to be dried at 150° for 20 min to prepare a photoreceptor 6.

(Coating Liquid for Surface Layer 2)

CTM having the formula (3)

Bisphenol Z-type polycarbonate (TS-2050 from Teijin Chemicals Ltd.)

Tetrahydrofuran

Cyclohexanone

Mixing ratio (weight): CTM/polycarbonate/tetrahydrofuran/cyclohexanone=4/5/170/50

The Martens hardness and the elastic power ratio of the photoreceptors 1 to 6 were measured and the results are shown in Table 2.

TABLE 2

| | Hardness (N/mm$^2$) | Elastic Power Ratio (%) |
|---|---|---|
| Photoreceptor 1 | 188 | 36.5 |
| Photoreceptor 2 | 195 | 36.6 |
| Photoreceptor 3 | 186 | 37.1 |
| Photoreceptor 4 | 201 | 38.1 |
| Photoreceptor 5 | 198 | 37.5 |
| Photoreceptor 6 | 184 | 36.8 |

Three hundred thousands (300,000) images were produced by iPSiO SP C811 with a combination of each of the cleaning blades 1 to 29 and the photoreceptors 1 to 6 (OPC) shown in Table 3.

Sheet: My Paper A4 from NBS Ricoh Co., Ltd.

Color: Black

Image Area Ratio: 0, 10 and 50% (different image area ratios in the same chart)

Toner Circularity: 98.1%

Volume-Average Particle Diameter of Toner: 5.2 μm

TABLE 3

| | Blade | OPC |
|---|---|---|
| Example 1 | 1 | 2 |
| Example 2 | 2 | 2 |
| Example 3 | 3 | 2 |
| Example 4 | 4 | 2 |
| Example 5 | 5 | 2 |
| Example 6 | 6 | 2 |
| Example 7 | 7 | 2 |
| Example 8 | 8 | 2 |
| Example 9 | 9 | 2 |
| Example 10 | 10 | 2 |
| Example 11 | 11 | 2 |
| Example 12 | 12 | 2 |
| Example 13 | 13 | 2 |
| Example 14 | 14 | 2 |
| Example 15 | 15 | 2 |
| Example 16 | 16 | 2 |
| Example 17 | 17 | 2 |
| Example 18 | 18 | 2 |
| Example 19 | 19 | 2 |
| Example 20 | 20 | 2 |
| Example 21 | 21 | 2 |
| Example 22 | 22 | 2 |
| Example 23 | 23 | 2 |
| Example 24 | 1 | 4 |
| Example 25 | 2 | 4 |
| Example 26 | 3 | 4 |
| Example 27 | 4 | 4 |
| Example 28 | 5 | 4 |
| Example 29 | 6 | 4 |
| Example 30 | 7 | 4 |
| Example 31 | 8 | 4 |
| Example 32 | 9 | 4 |
| Example 33 | 10 | 4 |
| Example 34 | 11 | 4 |
| Example 35 | 12 | 4 |
| Example 36 | 13 | 4 |
| Example 37 | 14 | 4 |
| Example 38 | 15 | 4 |
| Example 39 | 16 | 4 |
| Example 40 | 17 | 4 |
| Example 41 | 18 | 4 |
| Example 42 | 19 | 4 |
| Example 43 | 20 | 4 |
| Example 44 | 21 | 4 |
| Example 45 | 22 | 4 |
| Example 46 | 23 | 4 |
| Example 47 | 5 | 1 |
| Example 48 | 20 | 1 |
| Example 49 | 5 | 3 |
| Example 50 | 20 | 3 |
| Example 51 | 5 | 5 |
| Example 52 | 20 | 5 |
| Comparative Example 1 | 24 | 2 |
| Comparative Example 2 | 25 | 2 |
| Comparative Example 3 | 26 | 2 |
| Comparative Example 4 | 27 | 2 |
| Comparative Example 5 | 28 | 2 |
| Comparative Example 6 | 29 | 2 |
| Comparative Example 7 | 28 | 2 |
| Comparative Example 8 | 24 | 4 |
| Comparative Example 9 | 25 | 4 |
| Comparative Example 10 | 26 | 4 |
| Comparative Example 11 | 27 | 4 |

TABLE 3-continued

| | Blade | OPC |
|---|---|---|
| Comparative Example 12 | 28 | 4 |
| Comparative Example 13 | 29 | 4 |
| Comparative Example 14 | 5 | 6 |
| Comparative Example 15 | 20 | 6 |
| Comparative Example 16 | 28 | 6 |
| Comparative Example 17 | 29 | 6 |

The followings were evaluated.

[Evaluation Items]

Cleanability of cleaning blade

After 20 copies of an original image having three horizontal stripe images each having a width of 43 mm were produced, the stripe images were visually observed to determine whether the cleaning blade causes defective cleaning.

Blade surface observation

The surface of the blade was visually observed with a microscope VHX-100 from Keyence Corporation.

Figure 6:
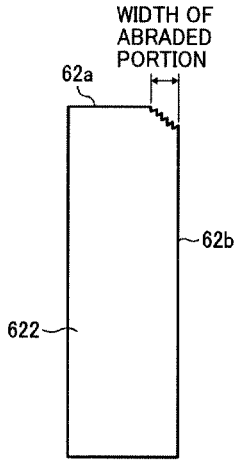
FIG. 6 is a schematic view for explaining the way to determine width of an abraded portion of an elastic blade.
Figure 7A:
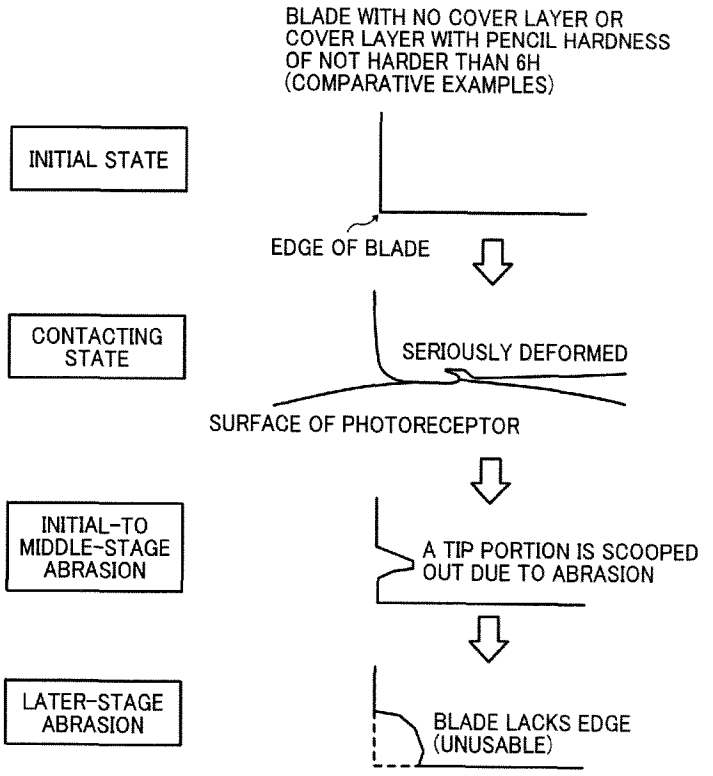
FIGS. 7A and 7B are schematic views for explaining differences between a cleaning blade of this disclosure and a comparative cleaning blade.
Figure 7B:
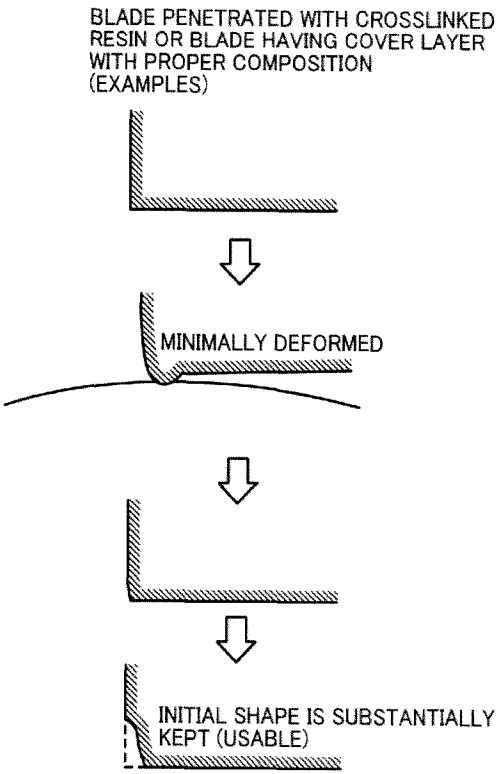

As FIG. 6 shows, an abrasion width of the blade edge was measured from the cross-section of an elastic blade similarly coated with a microscope VHX-100 from Keyence Corporation. The sample was cut by a trimming knife from Nisshin EM Corp.

The blade fluttering sound

Sounds while the images were ordinarily produced were heard.

Photoreceptor abrasion

The thickness of random 5 points of the photoreceptor were measured by a Fischerscope eddy current film thickness meter.

The results are shown in Tables 4, 5 and 6.

TABLE 4

| | Blade | | Blade Abrasion (μm) | |
|---|---|---|---|---|
| | Crack | Surface layer peeling | 15K | 30K |
| Example 1 | Good | Good | 28 | 62 |
| Example 2 | Good | Good | 23 | 49 |
| Example 3 | Good | Good | 15 | 32 |
| Example 4 | Good | Good | 14 | 27 |
| Example 5 | Good | Good | 15 | 31 |
| Example 6 | Good | Good | 12 | 26 |
| Example 7 | Fair | Good | 16 | 33 |
| Example 8 | Fair | Good | 13 | 28 |
| Example 9 | Fair | Good | 12 | 26 |
| Example 10 | Poor | Good | 10 | 21 |
| Example 11 | Good | Good | 14 | 29 |
| Example 12 | Good | Good | 15 | 29 |
| Example 13 | Good | Good | 13 | 27 |
| Example 14 | Good | Good | 15 | 29 |
| Example 15 | Good | Fair | 13 | 25 |
| Example 16 | Good | Good | 14 | 29 |
| Example 17 | Good | Good | 15 | 31 |
| Example 18 | Good | Good | 13 | 26 |
| Example 19 | Good | Good | 12 | 25 |
| Example 20 | Good | Good | 13 | 24 |
| Example 21 | Good | Good | 16 | 34 |
| Example 22 | Good | Good | 13 | 30 |
| Example 23 | Good | Good | 12 | 26 |
| Example 24 | Good | Good | 32 | 65 |
| Example 25 | Good | Good | 26 | 53 |
| Example 26 | Good | Good | 17 | 34 |
| Example 27 | Good | Good | 16 | 30 |
| Example 28 | Good | Good | 17 | 34 |

TABLE 4-continued

| | Blade | | Blade Abrasion (μm) | |
|---|---|---|---|---|
| | Crack | Surface layer peeling | 15K | 30K |
| Example 29 | Good | Good | 14 | 28 |
| Example 30 | Fair | Good | 18 | 36 |
| Example 31 | Fair | Good | 15 | 30 |
| Example 32 | Poor | Good | 14 | 28 |
| Example 33 | Good | Good | 11 | 23 |
| Example 34 | Good | Good | 16 | 32 |
| Example 35 | Good | Good | 17 | 33 |
| Example 36 | Good | Good | 15 | 29 |
| Example 37 | Good | Good | 17 | 33 |
| Example 38 | Good | Fair | 15 | 28 |
| Example 39 | Good | Good | 16 | 32 |
| Example 40 | Good | Good | 17 | 34 |
| Example 41 | Good | Good | 15 | 29 |
| Example 42 | Good | Good | 14 | 27 |
| Example 43 | Good | Good | 15 | 28 |
| Example 44 | Good | Good | 18 | 36 |
| Example 45 | Good | Good | 15 | 31 |
| Example 46 | Good | Good | 14 | 28 |
| Example 47 | Good | Good | 17 | 35 |
| Example 48 | Good | Good | 14 | 27 |
| Example 49 | Good | Good | 17 | 34 |
| Example 50 | Good | Good | 14 | 26 |
| Example 51 | Good | Good | 15 | 31 |
| Example 52 | Good | Good | 15 | 30 |
| Comparative Example 1 | Good | Poor | 79 | 160 |
| Comparative Example 2 | Good | — | 106 | 214 |
| Comparative Example 3 | Good | Poor | 89 | 180 |
| Comparative Example 4 | Good | — | 121 | 244 |
| Comparative Example 5 | Good | — | 154 | 311 |
| Comparative Example 6 | Good | — | 162 | 327 |
| Comparative Example 8 | Good | Poor | 88 | 175 |
| Comparative Example 9 | Good | — | 119 | 234 |
| Comparative Example 10 | Good | Poor | 100 | 197 |
| Comparative Example 11 | Good | — | 136 | 267 |
| Comparative Example 12 | Good | — | 172 | 340 |
| Comparative Example 13 | Good | — | 181 | 358 |
| Comparative Example 14 | Good | Good | 24 | 50 |
| Comparative Example 15 | Good | Good | 20 | 42 |
| Comparative Example 16 | Good | — | 189 | 403 |
| Comparative Example 17 | Good | — | 204 | 435 |

(Blade Crack)
Good: Not cracked
Fair: Slightly cracked
Poor: Totally cracked
(Surface Layer Peeling)
Good: Not peeled
Fair: Edge peeled
Poor: Totally peeled

TABLE 5

| | Clean ability | | Blade Sound | |
|---|---|---|---|---|
| | 15K | 30K | 15K | 30K |
| Example 1 | Good | Good | Good | Good |
| Example 2 | Good | Good | Good | Good |

TABLE 5-continued

| | Clean ability | | Blade Sound | |
|---|---|---|---|---|
| | 15K | 30K | 15K | 30K |
| Example 3 | Good | Good | Good | Good |
| Example 4 | Good | Good | Good | Good |
| Example 5 | Good | Good | Good | Good |
| Example 6 | Good | Good | Good | Good |
| Example 7 | Good | Good | Good | Good |
| Example 8 | Good | Good | Good | Good |
| Example 9 | Good | Good | Good | Good |
| Example 10 | Good | Fair | Good | Good |
| Example 11 | Good | Good | Good | Fair |
| Example 12 | Good | Good | Good | Good |
| Example 13 | Good | Good | Good | Good |
| Example 14 | Fair | Fair | Good | Good |
| Example 15 | Good | Good | Good | Good |
| Example 16 | Good | Good | Good | Good |
| Example 17 | Good | Good | Good | Good |
| Example 18 | Good | Good | Good | Good |
| Example 19 | Good | Good | Good | Good |
| Example 20 | Good | Good | Good | Good |
| Example 21 | Good | Good | Good | Good |
| Example 22 | Good | Good | Good | Good |
| Example 23 | Good | Good | Good | Good |
| Example 24 | Good | Good | Good | Good |
| Example 25 | Good | Good | Good | Good |
| Example 26 | Good | Good | Good | Good |
| Example 27 | Good | Good | Good | Good |
| Example 28 | Good | Good | Good | Good |
| Example 29 | Good | Good | Good | Good |
| Example 30 | Good | Good | Good | Good |
| Example 31 | Good | Good | Good | Good |
| Example 32 | Good | Good | Good | Good |
| Example 33 | Good | Fair | Good | Good |
| Example 34 | Good | Good | Good | Fair |
| Example 35 | Good | Good | Good | Good |
| Example 36 | Good | Good | Good | Good |
| Example 37 | Fair | Fair | Good | Good |
| Example 38 | Good | Good | Good | Good |
| Example 39 | Good | Good | Good | Good |
| Example 40 | Good | Good | Good | Good |
| Example 41 | Good | Good | Good | Good |
| Example 42 | Good | Good | Good | Good |
| Example 43 | Good | Good | Good | Good |
| Example 44 | Good | Good | Good | Good |
| Example 45 | Good | Good | Good | Good |
| Example 46 | Good | Good | Good | Good |
| Example 47 | Good | Good | Good | Good |
| Example 48 | Good | Good | Good | Good |
| Example 49 | Good | Good | Good | Good |
| Example 50 | Good | Good | Good | Good |
| Example 51 | Good | Good | Good | Good |
| Example 52 | Good | Good | Good | Good |
| Comparative Example 1 | Good | Poor | Fair | Poor |
| Comparative Example 2 | Fair | Poor | Good | Fair |
| Comparative Example 3 | Good | Poor | Fair | Poor |
| Comparative Example 4 | Fair | Poor | Good | Fair |
| Comparative Example 5 | Poor | Poor | Good | Good |
| Comparative Example 6 | Poor | Poor | Good | Good |
| Comparative Example 8 | Good | Poor | Poor | Poor |
| Comparative Example 9 | Fair | Poor | Fair | Fair |
| Comparative Example 10 | Good | Poor | Good | Poor |
| Comparative Example 11 | Fair | Poor | Fair | Fair |
| Comparative Example 12 | Poor | Poor | Good | Good |

TABLE 5-continued

| | Clean ability | | Blade Sound | |
|---|---|---|---|---|
| | 15K | 30K | 15K | 30K |
| Comparative Example 13 | Poor | Poor | Good | Good |
| Comparative Example 14 | Poor | Poor | Good | Good |
| Comparative Example 15 | Poor | Poor | Good | Good |
| Comparative Example 16 | Poor | Poor | Good | Good |
| Comparative Example 17 | Poor | Poor | Good | Good |

(Cleanability)
Good: Not contaminated
Fair: Edge contaminated
Poor: Totally contaminated
(Blade sound)
Good: No sound
Fair: Occasional
Poor: Constant

TABLE 6

(μm)

| | 15K | | | | 30K | | | | Uneven Abrasion |
|---|---|---|---|---|---|---|---|---|---|
| | 0% | 10% | 50% | Average | 0% | 10% | 50% | Average | ratio |
| Example 1 | 0.89 | 0.98 | 1.31 | 1.06 | 1.79 | 1.94 | 2.65 | 2.13 | 1.48 |
| Example 2 | 0.92 | 1.02 | 1.39 | 1.11 | 1.86 | 2.03 | 2.92 | 2.27 | 1.57 |
| Example 3 | 1.01 | 1.10 | 1.52 | 1.21 | 2.04 | 2.19 | 3.12 | 2.45 | 1.53 |
| Example 4 | 1.02 | 1.08 | 1.43 | 1.18 | 2.06 | 2.18 | 2.88 | 2.38 | 1.40 |
| Example 5 | 0.98 | 1.21 | 1.55 | 1.25 | 1.91 | 2.43 | 3.08 | 2.47 | 1.61 |
| Example 6 | 0.99 | 1.19 | 1.57 | 1.25 | 1.96 | 2.40 | 3.17 | 2.51 | 1.62 |
| Example 7 | 1.23 | 1.41 | 1.97 | 1.54 | 2.48 | 2.86 | 3.97 | 3.10 | 1.60 |
| Example 8 | 1.31 | 1.62 | 2.23 | 1.72 | 2.59 | 3.28 | 4.23 | 3.37 | 1.63 |
| Example 9 | 1.35 | 1.70 | 2.25 | 1.77 | 2.71 | 3.44 | 4.45 | 3.53 | 1.64 |
| Example 10 | 1.40 | 1.79 | 2.31 | 1.83 | 2.69 | 3.62 | 4.64 | 3.65 | 1.73 |
| Example 11 | 1.09 | 1.30 | 1.66 | 1.35 | 2.21 | 2.53 | 3.45 | 2.73 | 1.56 |
| Example 12 | 0.98 | 1.17 | 1.49 | 1.21 | 1.99 | 2.27 | 3.09 | 2.45 | 1.55 |
| Example 13 | 0.95 | 1.13 | 1.45 | 1.18 | 1.93 | 2.20 | 3.04 | 2.39 | 1.58 |
| Example 14 | 0.99 | 1.18 | 1.51 | 1.23 | 2.01 | 2.30 | 3.20 | 2.50 | 1.59 |
| Example 15 | 1.02 | 1.21 | 1.55 | 1.26 | 2.07 | 2.37 | 3.34 | 2.59 | 1.61 |
| Example 16 | 0.95 | 1.13 | 1.45 | 1.18 | 1.93 | 2.20 | 3.02 | 2.39 | 1.57 |
| Example 17 | 0.97 | 1.15 | 1.48 | 1.20 | 1.97 | 2.25 | 2.97 | 2.40 | 1.51 |
| Example 18 | 0.99 | 1.18 | 1.51 | 1.23 | 2.01 | 2.30 | 3.20 | 2.50 | 1.59 |
| Example 19 | 1.05 | 1.25 | 1.60 | 1.30 | 2.13 | 2.44 | 3.44 | 2.67 | 1.61 |
| Example 20 | 1.04 | 1.24 | 1.58 | 1.29 | 2.11 | 2.41 | 3.36 | 2.63 | 1.59 |
| Example 21 | 1.01 | 1.20 | 1.54 | 1.25 | 2.05 | 2.34 | 3.37 | 2.59 | 1.64 |
| Example 22 | 0.98 | 1.17 | 1.49 | 1.21 | 1.99 | 2.27 | 3.16 | 2.48 | 1.59 |
| Example 23 | 1.07 | 1.27 | 1.63 | 1.32 | 2.17 | 2.48 | 3.34 | 2.67 | 1.54 |
| Example 24 | 0.50 | 0.52 | 0.58 | 0.53 | 0.97 | 1.04 | 1.20 | 1.07 | 1.24 |
| Example 25 | 0.52 | 0.54 | 0.60 | 0.55 | 1.00 | 1.07 | 1.25 | 1.11 | 1.24 |
| Example 26 | 0.57 | 0.58 | 0.65 | 0.60 | 1.10 | 1.18 | 1.37 | 1.22 | 1.24 |
| Example 27 | 0.57 | 0.57 | 0.64 | 0.60 | 1.11 | 1.18 | 1.36 | 1.22 | 1.22 |
| Example 28 | 0.55 | 0.64 | 0.62 | 0.60 | 1.07 | 1.13 | 1.31 | 1.17 | 1.23 |
| Example 29 | 0.55 | 0.63 | 0.70 | 0.63 | 1.08 | 1.18 | 1.40 | 1.22 | 1.30 |
| Example 30 | 0.69 | 0.75 | 0.87 | 0.77 | 1.34 | 1.47 | 1.75 | 1.52 | 1.30 |
| Example 31 | 0.73 | 0.86 | 0.92 | 0.84 | 1.43 | 1.56 | 1.85 | 1.61 | 1.29 |
| Example 32 | 0.76 | 0.90 | 0.94 | 0.86 | 1.47 | 1.60 | 1.90 | 1.66 | 1.29 |
| Example 33 | 0.78 | 0.95 | 0.97 | 0.90 | 1.53 | 1.66 | 1.97 | 1.72 | 1.29 |
| Example 34 | 0.61 | 0.69 | 0.69 | 0.66 | 1.19 | 1.26 | 1.46 | 1.30 | 1.23 |
| Example 35 | 0.55 | 0.62 | 0.65 | 0.61 | 1.07 | 1.15 | 1.35 | 1.19 | 1.26 |
| Example 36 | 0.53 | 0.60 | 0.61 | 0.58 | 1.04 | 1.10 | 1.28 | 1.14 | 1.23 |
| Example 37 | 0.55 | 0.62 | 0.68 | 0.62 | 1.08 | 1.17 | 1.38 | 1.21 | 1.28 |
| Example 38 | 0.57 | 0.64 | 0.69 | 0.63 | 1.11 | 1.20 | 1.41 | 1.24 | 1.26 |
| Example 39 | 0.53 | 0.60 | 0.65 | 0.59 | 1.04 | 1.12 | 1.32 | 1.16 | 1.28 |
| Example 40 | 0.54 | 0.61 | 0.64 | 0.60 | 1.06 | 1.14 | 1.33 | 1.17 | 1.25 |
| Example 41 | 0.55 | 0.62 | 0.62 | 0.60 | 1.08 | 1.14 | 1.31 | 1.18 | 1.22 |
| Example 42 | 0.59 | 0.66 | 0.71 | 0.65 | 1.15 | 1.24 | 1.45 | 1.28 | 1.26 |
| Example 43 | 0.58 | 0.66 | 0.71 | 0.65 | 1.14 | 1.23 | 1.45 | 1.27 | 1.28 |
| Example 44 | 0.57 | 0.64 | 0.61 | 0.60 | 1.10 | 1.15 | 1.31 | 1.19 | 1.19 |
| Example 45 | 0.55 | 0.62 | 0.67 | 0.61 | 1.07 | 1.16 | 1.37 | 1.20 | 1.28 |
| Example 46 | 0.60 | 0.67 | 0.73 | 0.67 | 1.17 | 1.26 | 1.48 | 1.31 | 1.27 |
| Example 47 | 1.51 | 1.86 | 2.43 | 1.93 | 3.04 | 3.61 | 4.12 | 3.59 | 1.36 |
| Example 48 | 1.41 | 1.58 | 2.04 | 1.68 | 2.79 | 3.37 | 3.84 | 3.33 | 1.37 |
| Example 49 | 0.98 | 1.16 | 1.51 | 1.22 | 2.01 | 2.34 | 2.64 | 2.33 | 1.31 |
| Example 50 | 0.89 | 1.00 | 1.32 | 1.07 | 1.74 | 2.13 | 2.39 | 2.08 | 1.37 |
| Example 51 | 0.53 | 0.59 | 0.64 | 0.59 | 1.09 | 1.27 | 1.35 | 1.23 | 1.24 |
| Example 52 | 0.49 | 0.55 | 0.57 | 0.53 | 0.98 | 1.17 | 1.23 | 1.13 | 1.26 |
| Comparative Example 1 | 1.00 | 1.34 | 2.20 | 1.51 | 1.94 | 2.68 | 4.30 | 2.98 | 2.21 |

TABLE 6-continued

| | 15K | | | | 30K | | | | (μm) Uneven Abrasion |
|---|---|---|---|---|---|---|---|---|---|
| | 0% | 10% | 50% | Average | 0% | 10% | 50% | Average | ratio |
| Comparative Example 2 | 1.15 | 1.52 | 2.41 | 1.69 | 2.28 | 3.05 | — | — | — |
| Comparative Example 3 | 1.02 | 1.32 | 2.01 | 1.45 | 1.94 | 2.65 | 4.44 | 3.01 | 2.28 |
| Comparative Example 4 | 1.30 | 1.62 | 2.60 | 1.84 | 2.63 | 3.15 | — | — | — |
| Comparative Example 5 | 1.09 | 1.56 | 2.53 | 1.73 | 2.12 | 3.16 | — | — | — |
| Comparative Example 6 | 1.25 | 1.74 | 3.02 | 2.01 | 2.48 | 3.54 | — | — | — |
| Comparative Example 8 | 0.63 | 0.81 | 1.45 | 0.96 | 1.27 | 1.64 | 2.91 | 1.94 | 2.29 |
| Comparative Example 9 | 0.73 | 0.96 | 1.84 | 1.18 | 1.49 | 2.04 | 3.65 | 2.39 | 2.45 |
| Comparative Example 10 | 0.60 | 0.75 | 1.72 | 1.03 | 1.22 | 1.84 | 3.41 | 2.15 | 2.79 |
| Comparative Example 11 | 0.94 | 1.23 | 2.50 | 1.56 | 1.92 | 2.72 | 4.93 | 3.19 | 2.57 |
| Comparative Example 12 | 0.74 | 0.95 | 2.10 | 1.26 | 1.46 | 2.25 | 4.14 | 2.62 | 2.83 |
| Comparative Example 13 | 0.92 | 1.24 | 2.58 | 1.58 | 1.80 | 2.76 | — | — | — |
| Comparative Example 14 | 2.02 | 2.53 | 3.57 | 2.70 | 4.00 | — | — | — | — |
| Comparative Example 15 | 2.12 | 2.71 | 3.85 | 2.90 | 4.26 | — | — | — | — |
| Comparative Example 16 | 2.18 | 2.61 | 4.01 | 3.00 | 4.43 | — | — | — | — |
| Comparative Example 17 | 2.04 | 2.69 | 3.75 | 2.83 | 4.12 | — | — | — | — |

Uneven abrasion ratio = abrasion of 50% image area part/abrasion of 0% image area part In Examples 1 to 52, good cleanability could be maintained, and excessive abrasions, abnormal noises and edge eversion of the cleaning blades could be prevented for long periods. In addition, uneven abrasion when images having different toner amount parts were produced could be prevented. Meanwhile, Comparative Examples deteriorated in cleanability.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

a photoreceptor;

a charger configured to charge the surface of the photoreceptor;

an irradiator configured to irradiate the surface thereof to form an electrostatic latent image thereon;

an image developer configured to develop the electrostatic latent image with a toner to form a toner image;

a transferer configured to transfer the toner image onto a recording medium;

a fixer configured to fix the toner image on the recording medium; and a cleaning blade formed of a strip-shaped elastic blade and configured to contact an edge line to the surface of the photoreceptor, wherein the photoreceptor comprises a surface layer comprising a particulate material, and the edge line of the cleaning blade comprises:

a substrate of the elastic blade;

a mixed layer having a thickness not less than 1.0 μm, formed of the substrate and at least one of an acrylic resin and a methacrylic resin, located at the surface of the substrate; and a surface layer having a thickness not less than 0.1 μm, formed of at least one of an acrylic resin and a methacrylic resin, located on the surface of the substrate, wherein the surface layer of the photoreceptor has a Martens hardness from 184 N/mm$^2$ to 201 N/mm$^2$ and an elastic power ratio (We/Wt value) from 36.5% to 38.1%.

2. The image forming apparatus of claim 1, wherein the surface layer of the cleaning blade has a thickness of from 0.5 to 1.0 μm.

3. The image forming apparatus of claim 1, wherein the mixed layer of the cleaning blade has a thickness of from 10 to 30 μm.

4. The image forming apparatus of claim 1, wherein the particulate material included in the surface layer of the photoreceptor a particulate oxide.

5. A process cartridge detachable from image forming apparatus, comprising:

a photoreceptor comprising a surface layer comprising a particulate material; and a cleaning blade formed of a strip-shaped elastic blade and configured to contact an edge line to the surface of the photoreceptor, wherein the edge line of the clearing blade comprises:

a substrate of the elastic blade;

a mixed layer having a thickness not less than 1.0 μm, formed of the substrate and at least one of an acrylic resin and a methacrylic resin, located at the surface of the substrate; and a surface layer having a thickness not less than 0.1 μm, formed of at least one of an acrylic resin and a methacrylic resin, located on the surface of the substrate, wherein the surface layer of the photoreceptor has a Martens hardness from 184 N/mm$^2$ to 201 N/mm$^2$ and an elastic power ratio (We/Wt value) from 36.5% to 38.1%.

* * * * *